United States Patent [19]

Salgo

[11] 3,990,646

[45] Nov. 9, 1976

[54] WINDING APPARATUS

[75] Inventor: Leslie Salgo, Pickering, Canada

[73] Assignee: Imperial Oil Limited, Toronto, Canada

[22] Filed: Feb. 14, 1975

[21] Appl. No.: 549,817

Related U.S. Application Data

[62] Division of Ser. No. 288,074, Sept. 11, 1972, Pat. No. 3,908,923.

[52] U.S. Cl. ..... 242/56 A

[51] Int. Cl.[2] ..... B65H 19/20

[58] Field of Search ..... 242/58, 56 A, 56 R, 242/67.1 R, 64; 221/266; 156/566

[56] References Cited

UNITED STATES PATENTS

| | | | |
|---|---|---|---|
| 2,266,087 | 12/1941 | Schlemmer | 156/566 |
| 3,294,285 | 12/1966 | Kovacerie | 221/266 X |
| 3,567,145 | 3/1971 | Croix | 242/56 A |
| 3,610,545 | 10/1971 | Troisdorf | 242/56 R |
| 3,720,381 | 3/1973 | Rehme | 242/64 |
| 3,848,824 | 11/1974 | Schijndel | 242/56 A |

FOREIGN PATENTS OR APPLICATIONS

| | | | |
|---|---|---|---|
| 1,123,663 | 6/1956 | France | 242/56 R |
| 1,299,193 | 7/1969 | Germany | 242/67.1 R |
| 886,774 | 1/1962 | United Kingdom | 242/56 A |

*Primary Examiner*—Edward J. McCarthy

[57] ABSTRACT

According to the invention, winding apparatus comprises means for rotatably mounting a parent roll of web material, a mandril adapted to receive a hollow core sleeved thereon, means for driving the mandril in rotation, clutch means for providing limited torque transfer between the driving means and the core on the mandril, a core co-operating roll mounted for rotation, the core co-operating roll and mandril being relatively movable between an adjacent co-operating web feeding position to feed web led from the parent roll between the core co-operating roll and the core on the mandril to be nipped thereby and a separated position (constituting a loading and unloading station) to allow for sleeving of the core on and removal of the core from the mandril, and means for guiding the leading edge of the web nipped by the core co-operating roll and the core on said mandril around the core.

Further according to the invention, core feed means are provided comprising an open ended cradle adapted to accept and support an individual core while allowing axial core transfer endwise thereof mounted for movement between a substantially upright core pick-up position and a loading position displaced therefrom in which the cradle is oriented to support a core therein in axial alignment with the loading and unloading station of the winding apparatus, and core delivery means operating from a position clear of the cradle endwise through the said cradle and axially of the core supported therein with the cradle at the loading position to deliver the core and to thereafter return to its said position clear of the cradle.

22 Claims, 24 Drawing Figures

SEE FIG. 15
SEE FIG. 9
LV-1
LV-10

126
127
137
138
140
141
142
143
146
147
148
149
150
151
152
14
170
171
173
174
175
179
188
189
190
191
192a
193
194
196
198
199
200
201
203
204
233
234

POWER VALVES P1 TO P7

WINDING APPARATUS

This is a division of application Ser. No. 288,074, filed Sept. 11, 1972, now U.S. Pat. No. 3,908,923.

This invention relates to improvements in winding machines and more particularly to a winding machine wherein a web of material such as polyvinyl chloride, polyethylene, foil and the like is withdrawn from parent roll stock, wound on a core in the desired lengths and tabbed ready for consumer distribution and sale.

BACKGROUND OF THE INVENTION

The winding of a web of material presents a number of difficult problems. In particular, the tension in the web must be closely controlled at all times throughout the winding cycle comprising start of wind, winding and end of wind, so that the web is not ruptured, or stretched beyond its elastic limit, or allowed to become slack, yet at the same time the winding cycle must be as short as possible for efficient economical production. If at any time during winding the web is tensioned to an excessive degree although short of actual web rupture, web distortion occurs and for instance the web becomes necked or rippled, spoiling the appearance of the wound product. If the excessive tension is such as to stretch the web beyond its elastic limit then, in the case where the intended function of the web is to act as a stretchable material to be stretched on application and then allowed to contract to provide an effective seal, the wound web has no utility.

The core on which the web is wound must be of inexpensive construction such as a hollow tube of paper or other relatively inexpensive material which inherently limits the resistance of the core to collapse under pressure. This factor creates special problems since the web material cannot be wound without tensioning same causing at least some measure of stretch and since it is essential to restrict such stretching below the elastic limit of the material the web contracts on the core as soon as it is relieved of the winding tension thereby exerting a progressively increasing pressure on the core as the winding continues tending to cause core collapse. This web memory recovery or contraction occurs while the core is conventionally subject to lateral deflection between its end supports during winding due to web pull on the core, and leads to a high incidence of core collapse or buckling during winding, destroying the product and creating problems for its release from the winding station.

The web itself of course must be wound on the core free from start to finish of folds, creases, wrinkles or other disconformities, and the length of web wound must be held constant to the intended specified length. Apart from the matter of controlling tension in the web during the actual winding operation the severing of the tensioned web when a sufficient length of material has been wound on the core presents special problems. As will be appreciated, as the tensioned web parts it will have a backlash tendency in both directions away from the line of severance and if the trailing edge of the web material wound on the core is not controlled or the web is not uniformly tensioned, such trailing edge will either not lie symmetrically along the outside of the core or will be distorted or ragged and will not lie smooth against the outside of the core. On the other hand, if the flying leading edge of the parent web stock is not properly controlled, start of the winding of the next succeeding core either cannot be effected or, alternatively is effected, but with such leading edge either not lying uniformly along or smooth against the core. Both improper winding starts or finishes affect the acceptability of the product particularly where the web is a clear transparent material such as PVC or polyethylene.

The above problems have not been overcome by the winding machines of the prior art and their inability to control web tension and web severance has led to frequent web rupture and consequent machine function interruption and loss of product, to frequent core collapse due to web contraction with consequent machine function interruption and loss of product and to frequent web necking, wrinkling, creasing and other nonuniformities and core appearance distortion and again, loss of product.

Again, because of the inherent weakness of the economically acceptable hollow or tubular core structure, a difficult problem is presented to adequately support the core during winding in a manner which will enable the core to be delivered to and removed from the winding station. Also the requirement that the winding be controlled to wind an accurate length of web rather than to wind for a specific length of time has presented special problems in the feeding of the empty cores to and the removal of the wound cores from the winding assembly while at the same time ensuring positive core delivery and removal at the appropriate time.

When the core is wound with the requisite length of web the wound core is desirably required to be tabbed or labelled with a circumferentially extending, preferably central, tab adhered across the trailing edge of the web on the core, and to an under layer or portion of the web next adjacent the trailing edge, the tab having a free non adhered portion to be gripped by the fingers and pulled to commence roll unwinding. As will be appreciated, therefore, the trailing edge of the web in the wound core must be indexed accurately to enable the tabbing or labelling to be carried out automatically. Such indexing or maintenance of a constant orientation of the sometimes almost invisible trailing edge must be accomplished following high speed core rotation during winding and subsequent stoppage and delivery out of the winding apparatus and heretofor no satisfactory automatic tabbing arrangement has been provided.

Objects and Summary of the Invention

It is the object of the present invention to overcome the problems of the prior art and to provide a winding mechanism in which the tension of the web is accurately controlled from start up to finish of the winding of the core without rupture of the web or stretching the web beyond its elastic limit.

Another important object is to provide a winding start up that ensures that the web lies smoothly and accurately along the core without any creasing, folding or other unevenness.

Another important object is to eliminate all backlash problems in the web severance.

Still another object is to support the core against bowing, distorting or collapse during the winding.

Again, it is an object to ensure that the length of web wound on the core accurately corresponds to the core length desired.

A further important object is to provide a winding apparatus to accomplish the aforesaid objects which is of relatively simple, inexpensive and highly reliable construction.

Again it is an object to ensure positive core delivery to and positive wound core ejection from the winding apparatus without damage to the core or product.

Again it is an object to provide positive core feed accurately timed to feed a fresh core to the winding apparatus immediately after ejection of a wound core regardless of the winding time required to wind the desired predetermined core length.

Still a further object is to provide for a positive wound core ejection immediately on cessation of winding and web severance regardless of the winding time required to wind the desired predetermined core length.

Again it is an object to provide positive wound core ejection as aforesaid in which the trailing edge of the wound web has a precise constant orientation and to deliver such ejected core to be labelled while presenting the wound core and the trailing edge of the wound web to the labelling mechanism always in the same desired predetermined orientation.

Still another important object is to provide core feed, wound core ejection, wound core transfer and labelling apparatus, all precisely co-ordinated regardless of winding time whereby the entire function of feeding, winding, ejection and tabbing of the core can be effected automatically and rapidly. Again, a further important object is to provide apparatus of such a nature which will be relatively simple, inexpensive and highly reliable construction.

According to the invention, in the winding operation, relative movement between a core and a rotatable surface or roller is first effected preferably by translation of the core towards the rotatable surface, to move same from a separated, loading and unloading position or station to an adjacent position to cause the core to nip the web of the parent roll against the rotatable surface at a point such that a free starting length of parent roll web hangs below the core. Such starting web length is then conformed around the core to initiate core winding and the core is rotated with limited torque to draw a length of web from the parent roll while winding same on the core. Thereafter the core and rotatable surface are separated, preferably again by translating the core away from the rotatable surface to provide or draw off a core length beyond the rotating surface and the core rotation is stopped and the web severed while controlling web backlash immediately adjacent to the core whereby the core length drawn beyond the rotating surface drops downwardly and forms the starting web length for the next succeeding core in the repeating of the winding cycle.

Further according to the invention, the rotating surface against which the core nips the web is utilized as the means of measuring the length of web drawn from the parent roll as a result of core rotation and its rotation through a predetermined number of revolutions is utilized to signal core translation away from the rotating surface and cessation of core rotating surface and parent roll rotation.

Also according to the invention the parent roll rotation is controlled to provide an external drag after the parent roll has been accelerated to winding speed, the drag being regulated to decrease as the diameter of the parent roll decreases as the web is withdrawn therefrom to prevent the web from overfeeding and becoming slack which would result in folding or creasing due to the rotational inertia of the parent roll system, the drag however always being such that the tension in the web will not cause slippage of the core when the core has reached winding speed.

Further according to the invention, the core is supported sleeved on a mandril during winding for driving thereby through a torque limited clutch and means are provided for ejecting a wound core from the mandril and for the sleeving of a fresh core on the mandril, the ejection of the wound core being signalled following translation of the wound core to the loading-unloading station, stoppage of the mandril rotation and severance of the web adjacent to the wound core, and the arrival of the fresh core sleeved on the mandril signalling the translation of the mandril from the loading-unloading station to nip the web against the rotating surface.

Still further according to the invention, the arrival of the core adjacent to the web nipping position signals the conforming of the starting length of web around the core and rotation of the mandril, the parent roll and rotating surface having been released for rotation at this time.

Again according to the invention the conforming of the starting length of web around the core is accomplished by the use of an arrangement of circumferentially deflected and directed air jets without requiring the physical handling and potential impairment of the leading edge of such starting length.

According to the invention, in the core feeding, individual cores are isolated from a core stack at a loading station, translated while being supported free for axial movement into axial alignment with the winding mandril then moved axially to effect a sleeving of the core onto the mandril.

In this connection, according to the invention, the support means for the core during translation to the position of axial alignment with the mandril comprises a cradle, and the core is delivered axially onto the mandril by means of a piston operating axially through the cradle.

According to another aspect of the invention, the feed of cores from the core stack to the cradle is effected by arranging the cores to be delivered as a vertical stack, with the cores vertically aligned and providing a star wheel arrangment wherein the wheel is rotated on an axis offset from the vertically aligned cores and the spokes or prongs of the wheel being adapted to successively arrive at a position to block downward movement of the lowermost undelivered core and the weight of the cores above the blocking prong being sufficient to rotate the star wheel and allow delivery of the lowermost core, and means are provided to block star wheel rotation in the absence of a cradle in vertical registration with the core stack and to allow star wheel rotation on the bringing of a cradle into such vertical registration to effect delivery of the lowermost core to the cradle, the presence of the lowermost core in the cradle then blocking further star wheel rotation.

According to the invention, in the wound core ejection, the wound core is axially sleeved off the mandril with the severed trailing edge of the web in a predetermined orientation into an open clam moved into axial alignment with the mandril. The clam is then closed to deliver the wound core out of axial mandril alignment to the tabbing station while retaining the relative orientation of the wound core and clam whereby the tabbing is properly effected at the web trailing edge.

Further according to the feed and ejection aspect of the invention, the cradle and clam are connected to move in synchronization to successively feed a core and successively accept a wound core.

Further according to the invention in the tabbing operation, the tab delivering mechanism is actuated as a consequence of the movement of the wound core carrying clam to effect simultaneous advancement of the tab towards the wound core and advancement of the wound core towards the tab whereby tabbing is effected at a tabbing position intermediate of the starting position of both tab and wound core.

Also in accordance with this aspect of the invention, a tab is moved with a wiping motion to contact the trailing web edge on the wound core and move same in a direction to tighten the outermost layer of web prior to sealing of the tab to bridge across the trailing web edge and adjoining web surface.

Again, in connection with the tabbing according to the invention, the end tabs are mounted in precise sequential orientation on a carrier strip provided with a row of feed holes and cog wheel means are provided to engage the holes in the carrier strip to provide positive advancement and accurate registration of the end tabs in position to be picked off by the tab delivery mechanism.

Further in accordance with the preferred embodiment of the invention, the tab delivery mechanism incorporates a vacuum head to pick off tabs from the carrier strip and additional air jet means are employed to lift the tab from the carrier strip and urge same towards the vacuum head as vacuum is applied thereto. Also during tab application the vacuum head is converted from a vacuum tab holding means to a positive air jet tab delivery means.

According to the tabbing aspect of the invention, the end tabs or labels are in the form of narrow elongated tabs having an adhesive carrying length to be adhered circumferentially of the wound core adjacent the center thereof in bridge across the trailing web edge to tack the trailing web edge to an under web surface, and a finger gripping portion free of adhesive, extending from the portion of the adhesive carrying length effecting the tacking down of the trailing web edge. These tabs are mounted in spaced parallel relation on the carrier strip with their length extending transversely of the strip length and the cog wheel is arranged to feed such strip and tabs laterally in a direction parallel to the length of the wound core to the tab pick up station and the tab delivery mechanism is adapted to move in its wiping action in a plane perpendicular to the length of the wound core.

Again, in accordance with the invention, the core pick up and transfer cradle mechanism, the wound core receiving, clamping and transfer mechanism, and the tab feeding and delivery mechanism are all positively mechanically interconnected which such positively inter-connected mechanisms are responsive in unison to signals associated with the winding apparatus, whereby on delivery of a wound core into the clam mechanism the cradle is actuated to deliver the lowermost core from the core stack to axial alignment with the mandril; the delivered wound core is tranferred by the clam mechanism to the tabbing position and the tab applied and on delivery of a core onto the mandril the cradle is returned to pick up the next lowermost core, the clam is returned to receive the next wound core and the tabbing mechanism is returned to pick up the next tab.

These and other objects and features will become apparent from the following detailed description taken in conjunction with the accompanying drawings.

Figures 12, 13:
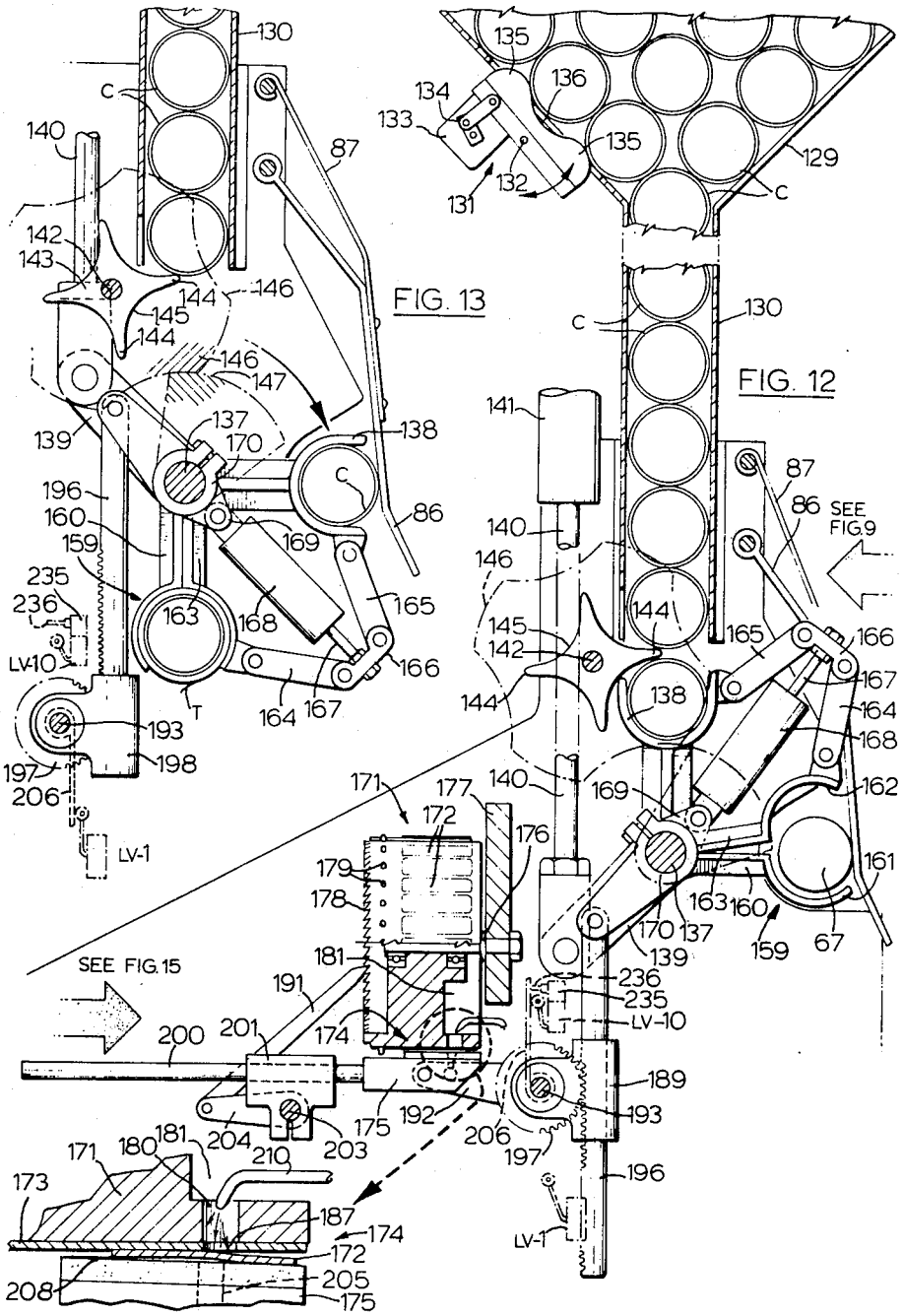

FIG. 12 is a part vertical section, part elevational view of the core handling apparatus and illustrating the relationship of the parts with the cradle at the core pick-p and receiving position and the clam at the core loading and unloading position and opened in preparation to recieve a wound core ejected from the winding apparatus, the view further showing the picker head at the tab pick-up position, the circled portion of which being also shown enlarged.

FIG. 13 is a view similar to FIG. 12 but showing the turret of the core feed apparatus rotated to bring the core carrying cradle to the core loading position and the wound core carrying clam to the tabbing position with the clam closed.

Figures 14, 15:
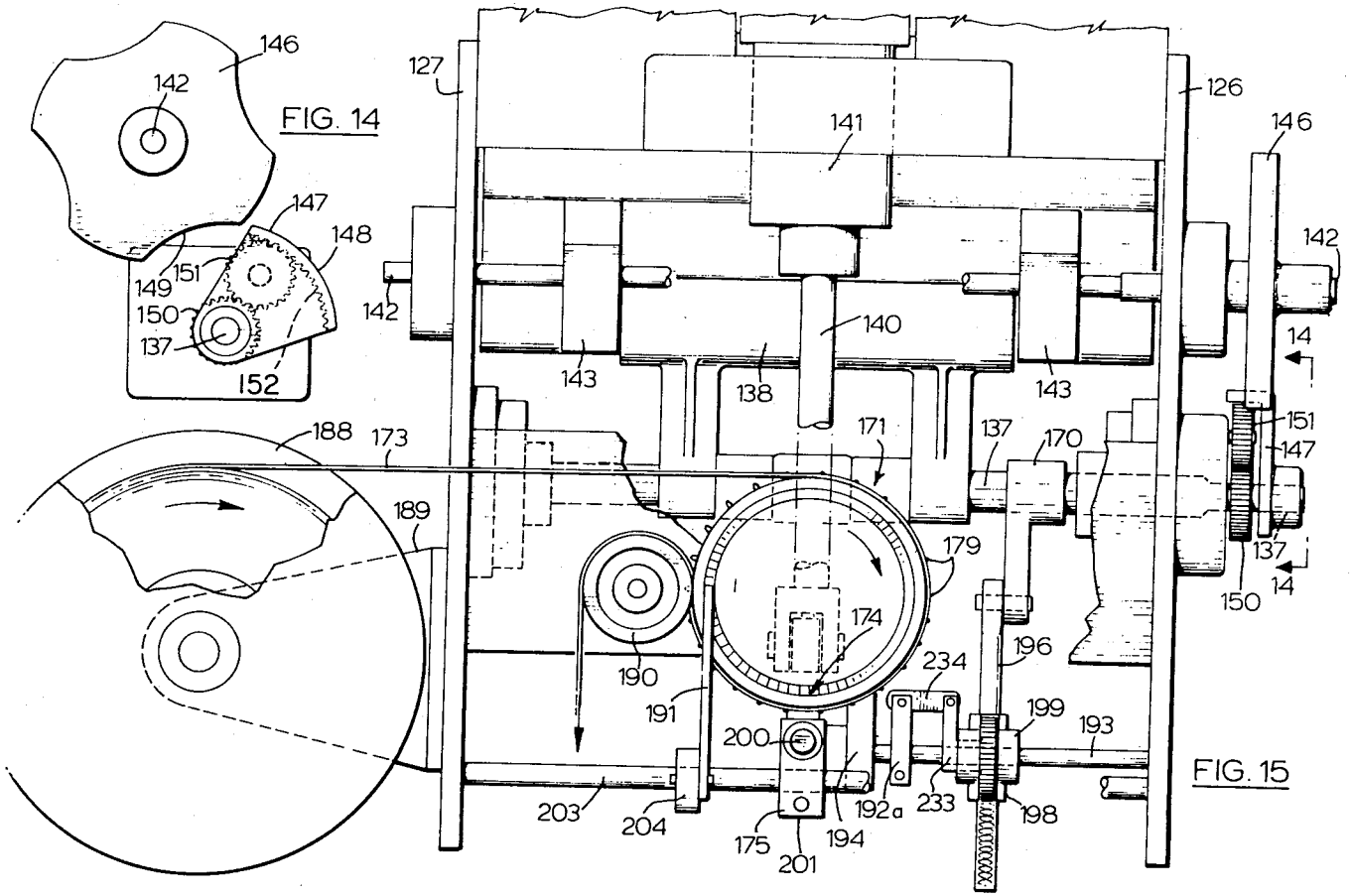

FIG. 14 is an elevational view showing the relationship between the main turret shaft, the scalloped cam on the star wheel shaft and the blocking counter cam with the cradle in core pick-up position.

FIG. 15 is a rear elevational view broken-away of the core transfer mechanism showing the tab feed and the picker head at tab pick-up position with the cradle in core pick-up position.

Figure 16:
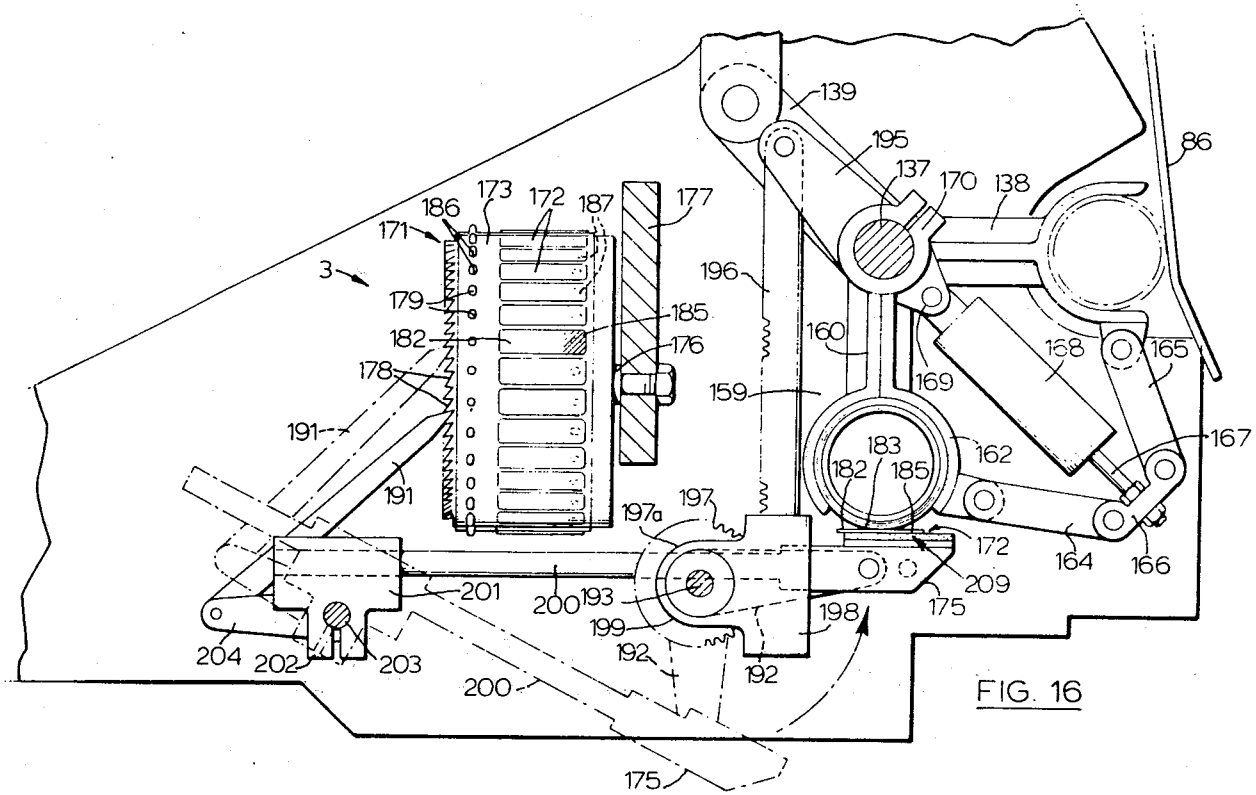

FIG. 16 is a side elevational view of the tabbing mechanism showing the picker head in solid line at the tab applying position to apply a tab to the wound core clamped in the clam.

Figure 17:
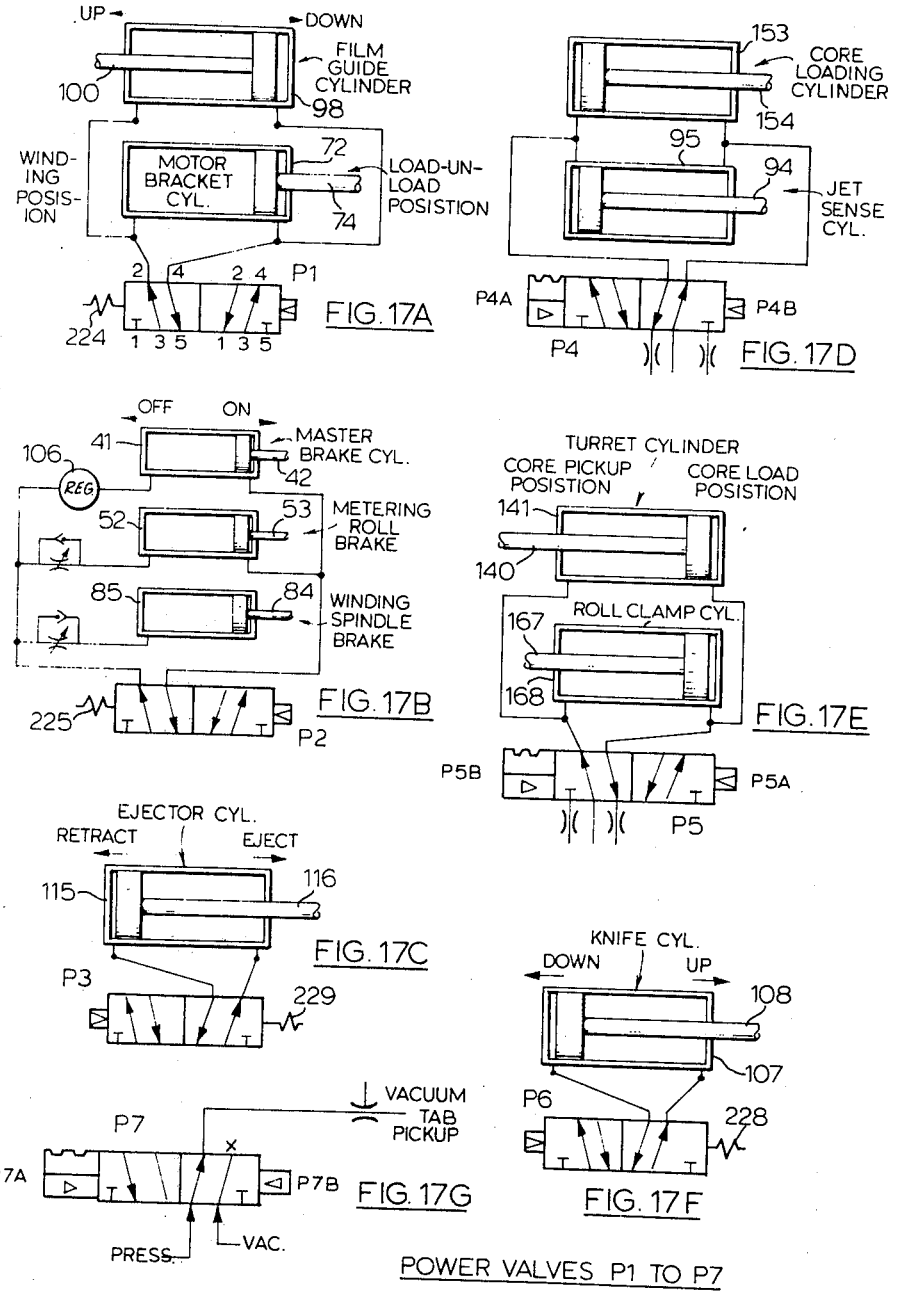

FIG. 17A is a pneumatic schematic diagram of the film guide cylinder and mandril carrying motor bracket cylinder and the power valve control.

FIG. 17B is a similar diagram of the brake cylinder arrangement.

FIG. 17C is a similar diagram of the ejector cylinder arrangement.

FIG. 17D is a similar diagram of the core loading cylinder and jet core sensing cylinder arrangement.

FIG. 17E is a similar diagram showing the turret cylinder and roll clamp cylinder arrangement.

FIG. 17F is a similar diagram of the knife cylinder arrangment.

FIG. 17G is a diagram of the vacuum controlling power valve.

Figure 18:
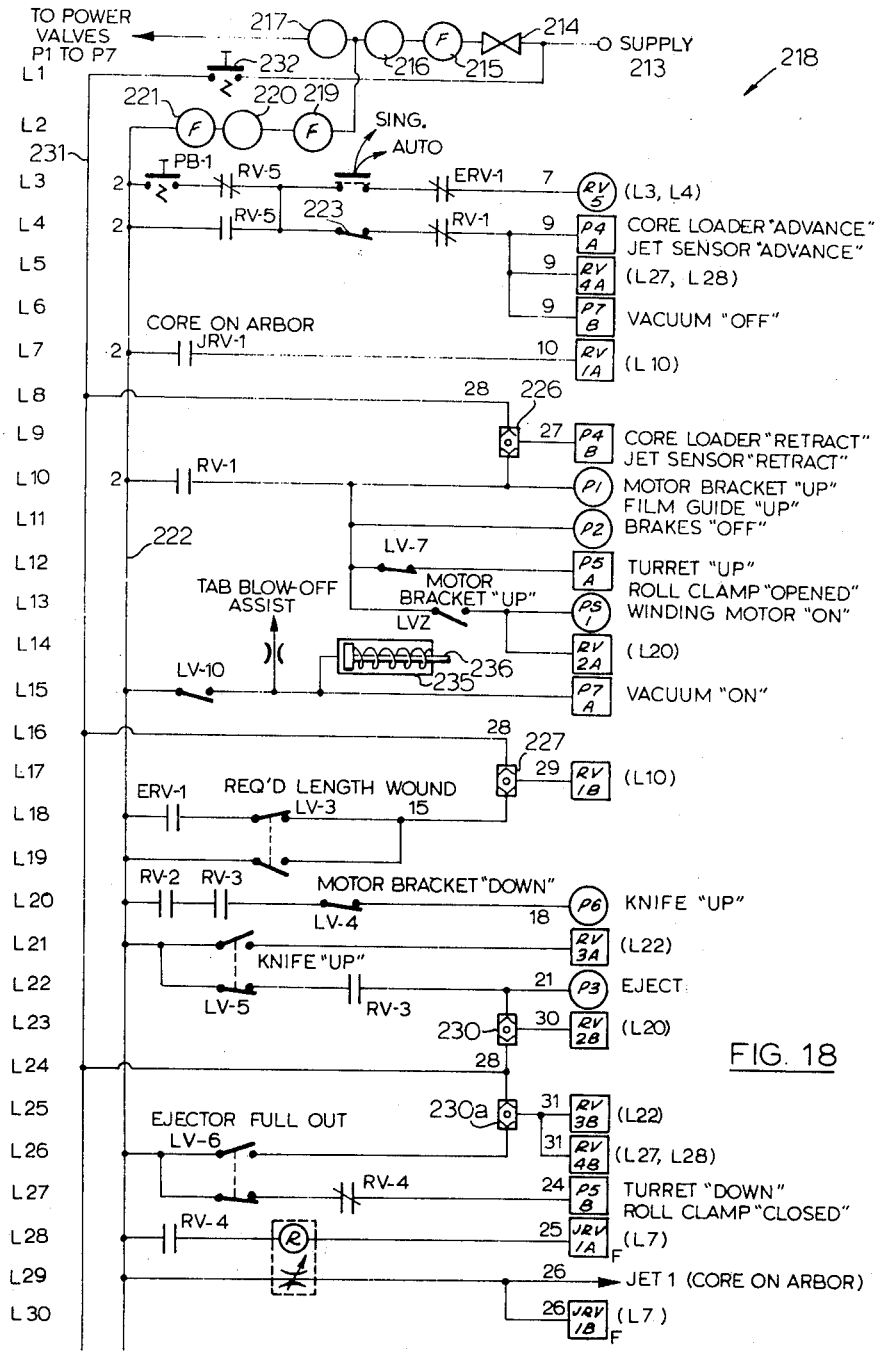

FIG. 18 is a schematic diagram of the air control circuit for operating the apparatus.

DETAILED DESCRIPTION OF THE DRAWINGS – GENERAL

Figure 1:
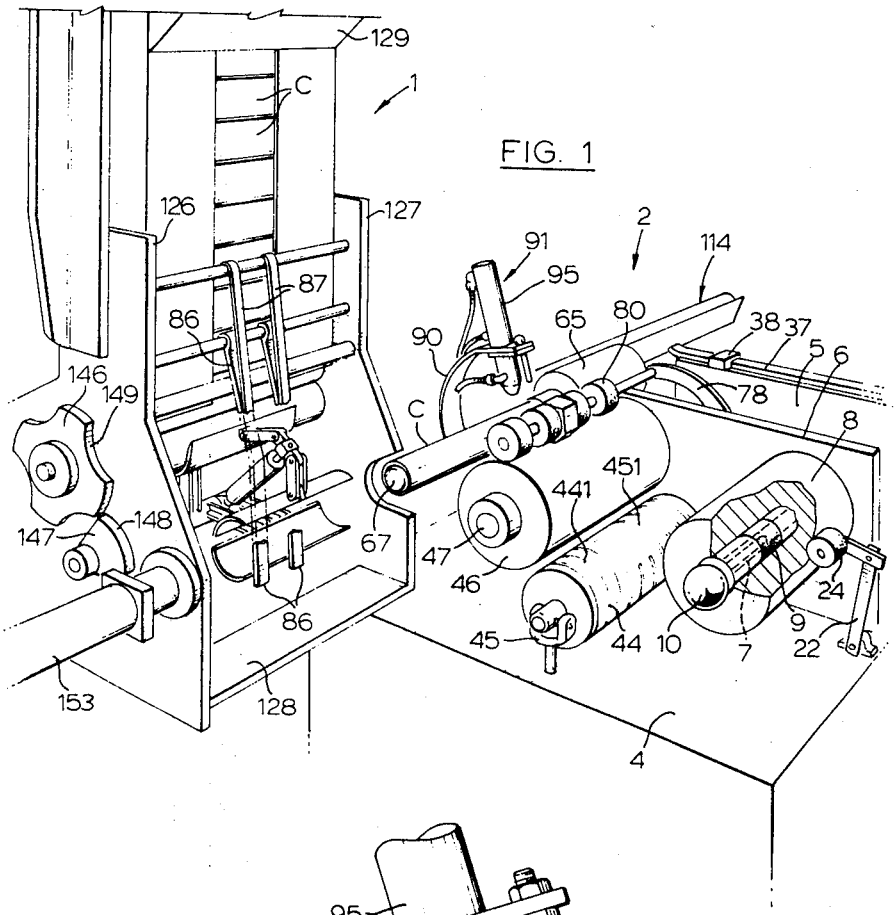
FIG. 1 is a perspective view partly broken away of an automatic core winding apparatus embodying the invention and showing the relationship of the mechanism such that a wound core is about to be ejected from the winding apparatus to the open wound core tranfer clam and with a fresh core received in the tranfer cradle.
Figure 2:
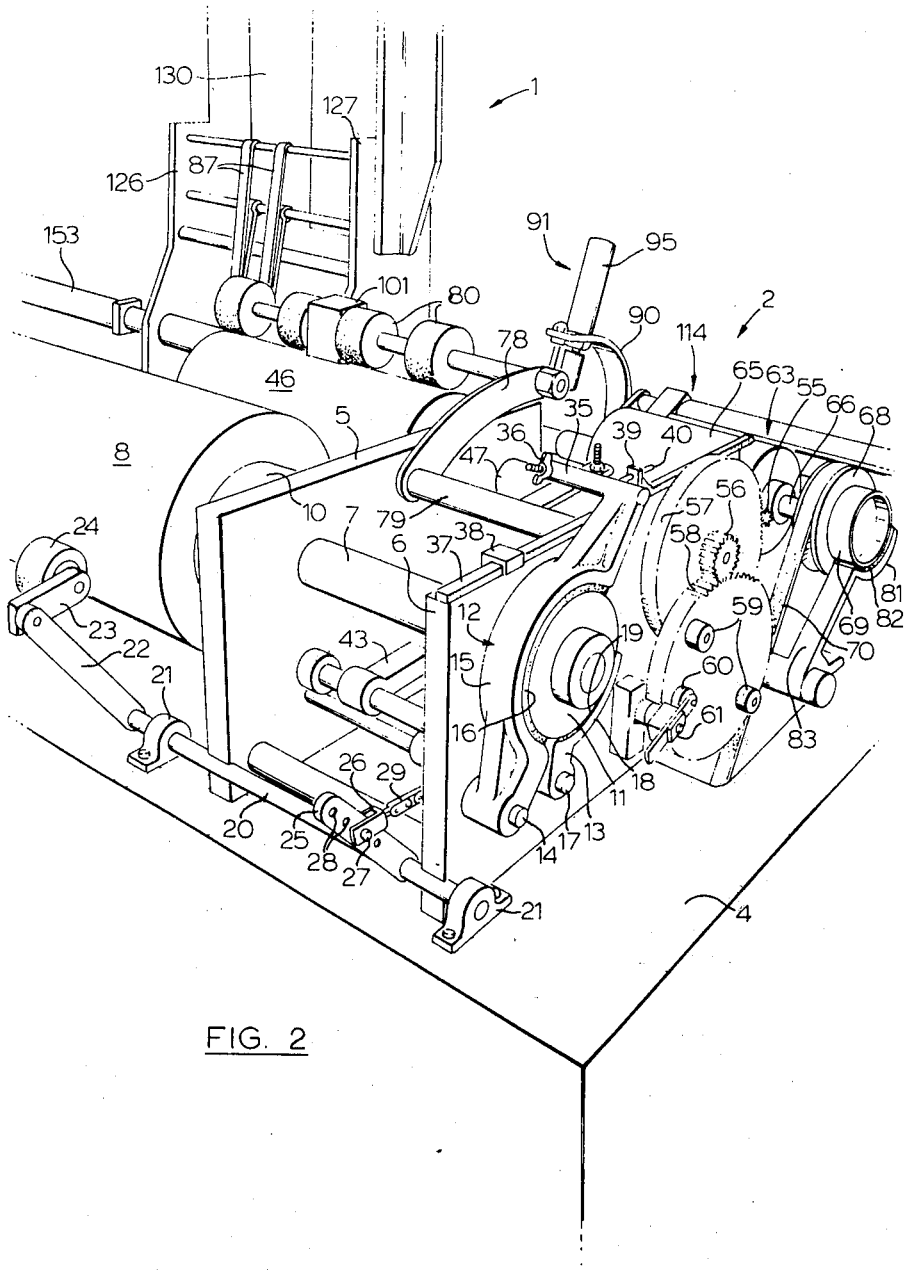
FIG. 2 is a perspective view partly broken away of the apparatus of FIG. 1 taken from the opposite side of the apparatus.

With reference particularly to FIGS. 1 and 2, an automatic winding machine embodying the invention comprises a core feed or tranfer mechanism generally designated at 1 for feeding a core to a winding apparatus generally designated at 2, accepting a wound core ejected from the winding apparatus 2 and transferring it to a tabbing station to have a tab applied thereto by a tabbing mechanism generally designated at 3 in FIG. 16. For fully automatic operation, the functioning of the mechanism 1, 2 and 3 are inter-related to effect first a fresh core advance from a core supply to a loading station and the loading of the core onto the winding apparatus, the winding of the core with the web of material until the predetermined length of web material has been wound thereon, the ejection of the wound core out of the winding apparatus, the transfer of the ejected wound core to the tabbing apparatus and the tabbing thereof.

Winding Apparatus

Figure 3:
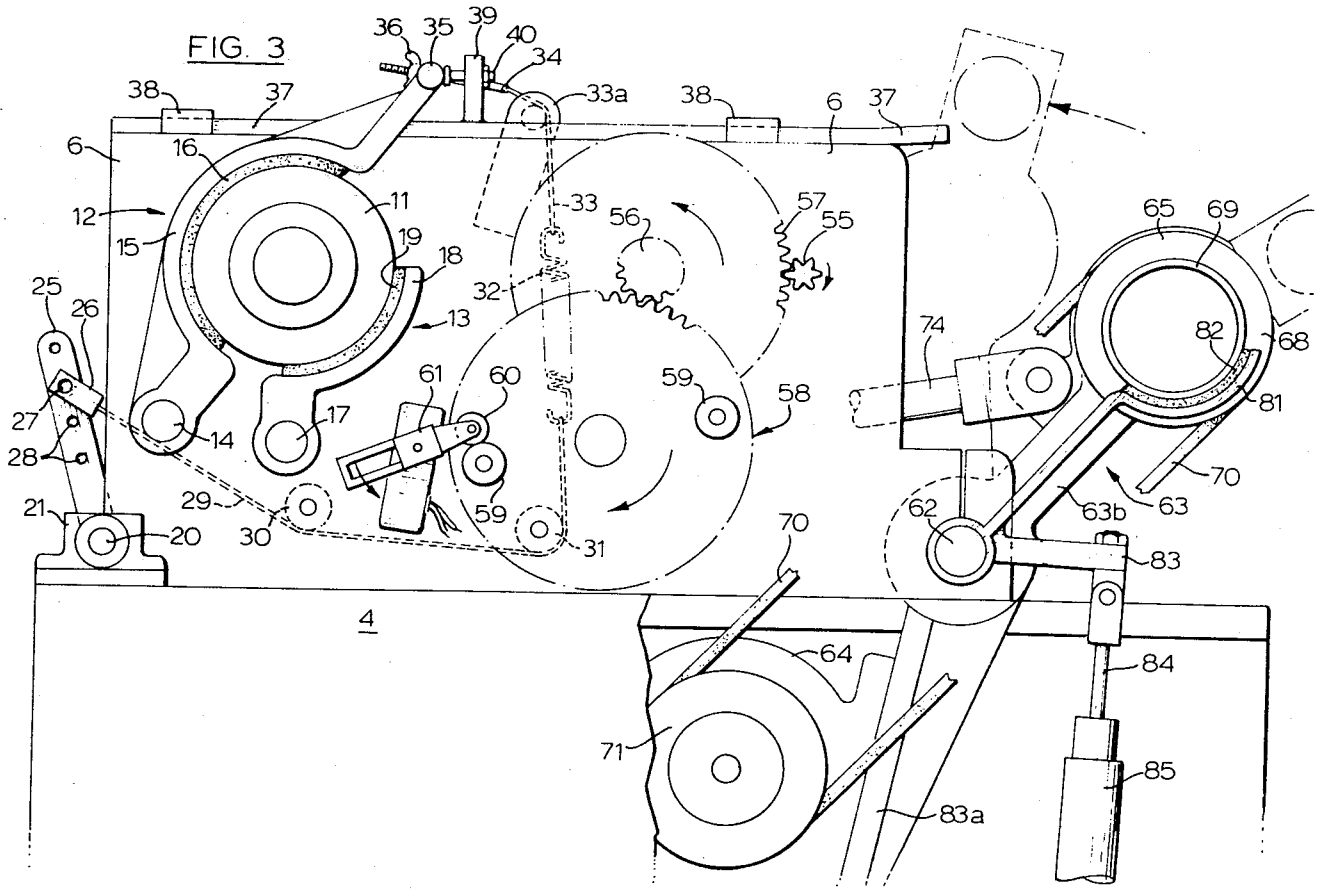
FIG. 3 is a side elevational view partly broken away of the winding apparatus and illustrating in dotted line the translational movement of the motor bracket.

As shown in FIGS. 2 and 3 the winding apparatus 2 is carried by the main machine table 4 which carries spaced vertical plates 5 and 6. Extending through and journalled in the support plates 5 and 6 is a parent roll shaft 7 on which is mounted a parent roll 8 of the web or film to be wound on the cores and comprising, for example, a web of polyvinylchloride or polyethylene. The parent roll of web material 8 is secured to the parent roll shaft 7 for rotation therewith by any suitable means. For example, the shaft 7 may be a radially expandable shaft of the type employing a compressible rubber sleeve 9 expanded by an end fitting 10. Secured on the parent roll shaft 7 on the side of the plate 6 remote from the parent roll is a brake drum 11 with which co-operates a drag brake 12 and a stoppage brake 13. The drag brake 12 comprises an arm pivoted at 14 and having an arcuate portion 15 encompassing a portion of the brake drum 11, the arcuate portion carrying a brake lining 16 of suitable friction material. The stoppage brake 13 is fixed to pivot shaft 17 and has an arcuate portion 18 encompassing a portion of the brake drum 11 and carrying a suitable brake lining 19.

Mounted at the rear of the table is a shaft 20 supported in bearings 21 and carrying at one end a lever arm 22 fixed thereto, the lever arm in turn carrying an arm 23 on the end of which is mounted a roller 24 adapted to roll against the periphery of the parent roll 8. Mounted on the shaft 20 is a further lever arm 25 to which is attached a yoke 26 by means of a pin 27 adapted to fit in a selected hole 28 in the lever arm. Attached to this yoke is a chain 29 which passes under idler rolls 30 and 31 and connects to the lower end of a spring 32, the upper end of which is connected by means of a cable 33 passing over idler **33*a* to the end of a threaded rod 34 which passes through a laterally extending arm 35 carried by the drag brake 12 and is held in adjustable position by means of a nut 36, all as shown particularly in FIGS. 2 and 3**.

Figure 4:
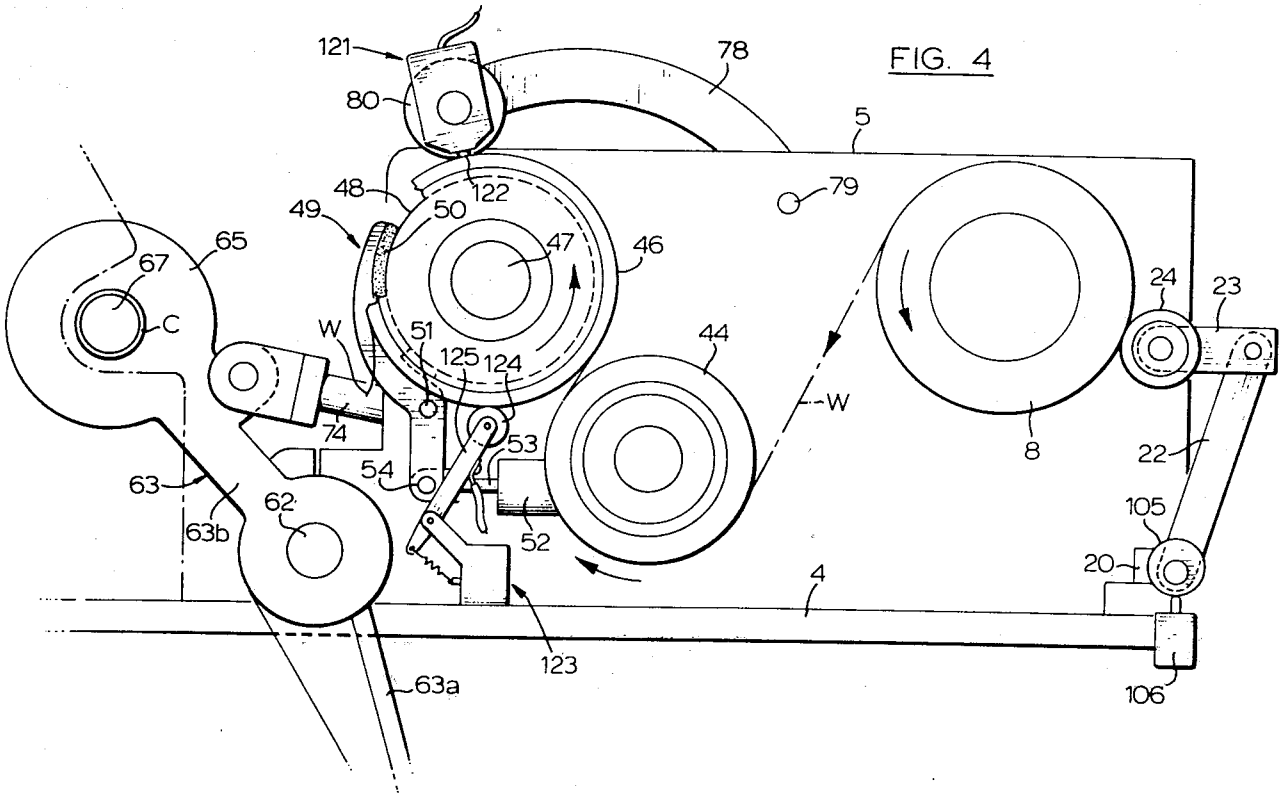
FIG. 4 is a side elevational view of the winding apparatus taken from the opposite side to that illustrated in FIG. 3 with the motor bracket and mandril at the core loading and unloading station, some of the parts being omitted for the sake of clarity.
Figure 5:
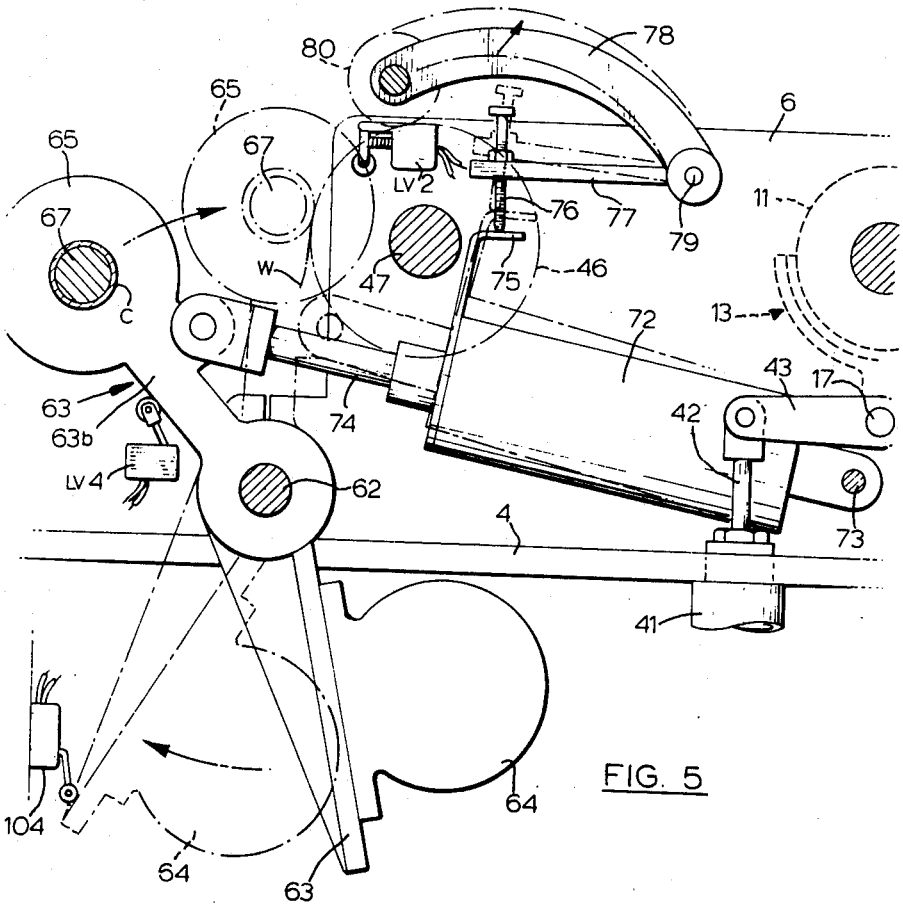
FIG. 5 is a view similar to FIG. 4 but illustrating in dotted line the movement of the motor bracket and winding mandril to the winding position and with the backlash rolls moved out of co-operation with the core co-operating metering roll.

Thus is will be seen that the roller 24 and the associated parts constitutes a parent roll diameter measuring or sensing device which on being pushed counter-clockwise as is viewed in FIGS. 2 and 3 by the presence of a large diameter parent roll 8, displaces lever arm 25 counter-clockwise to apply tension to the spring 32 which in turn applies tension to the drag brake 12 through the cable 33 passing over the idler roll **33*a* and the threaded rod 34. The adjustment of the nut 36 provides adjustment of the tension applying the drag brake 12 for a given parent roll diameter. Mounted on the top of the plate 6 for longitudinal sliding movement is a bar 37 passing under guides 38. This bar 37 carries a vertical projection 39 which carries a threadably adjustable headed pin 40 arranged to contact the drag brake arm 35 when the bar 37 is slid to the rear of the table to lift the drag brake out of braking engagement with the parent roll brake drum 11. The parent roll shaft stoppage brake 13 is operated by an air cylinder 41 as shown in FIG. 5 which has a piston 42 pivotally connected to the end of a lever arm 43 attached to the shaft 17. As shown particularly in FIGS. 1 and 4 the film or web W drawn off the parent roll is led around an idler spreading roll 44 journalled between the plate 5 and a bracket 45 mounted on the table 4 and over the top of a co-operating and metering roll 46 carried on a shaft 47 extending through and journalled in the plates 5 and 6. The web spreading roll 44 is formed of rubber or the like and has outwardly directed left and right hand spiral grooves 441 and 451 formed therein which on rotation act to spread the web towards the end of the roll and eliminate longitudinal web creases. As illustrated in FIG. 4, the core co-operating and metering roll shaft 47 carries a brake drum 48 with which co-acts a stoppage brake 49 having a suitable brake lining 50. The brake 49 comprises an arm pivoted intermediate its length at 51 and operated by an air cylinder 52 having a piston 53 connected to the lower end 54 of the brake arm. As shown in FIGS. 2 and 3 the shaft 47 carries a smaller gear 55 presented at the side of the plate 6 opposite to the roll 46. The gear 55 meshes with rotation reducing gears 56 and 57 to drive a cam carrying gear 58. The cam carrying gear as shown in FIG. 3 is provided with roller cams 59 which on rotation of the gear 58 are adapted to contact the roller 60 of a pivoted control arm 61 for controlling the functioning of the apparatus as hereinafter described. It will be understood that the arrangement is such that the control arm 61 will be operated following a predetermined number of rotations of the core co-operating and metering roll 46 and such predetermined number of revolutions of the roll 46 will determine the length of the web W delivered over the metering roll. Hence by setting the cams 59 at appropriate locations on the cam carrying gear 58, a predetermined length of web feed before operation of the control arm 61 can be effected. As shown in FIGS. 2, 3 and 5 particularly, mounted towards the front of the table on a shaft 62 is a motor bracket 63 having a depending arm 63***a* extending below the table 4 on which is mounted a motor 64. An upwardly extending arm portion 63*b* of the bracket 63 carries a hub 65 in which is journalled a shaft 66 best seen in FIG. 2. A portion of the shaft 66 extends to one side of the plates 5 and 6 with its axis parallel to the axis of the parent and core co-operating rolls 8 and 46 and constitutes the winding mandril 67 shown particularly in FIGS. 1 and 6 to 10.

The shaft 66 as shown in FIGS. 2 and 3 carries at the opposite side of the plates 5 and 6 a pully 68 and a brake drum 69. A belt 70 connected between the pully 68 and a motor pully 71 provides the drive from the motor to the mandril 67.

The motor bracket 63 is adapted to be rocked by an air cylinder 72 pivotally supported at 73 and having a piston 74 pivotally connected to the motor bracket as shown particularly in FIG. 5. Also as shown in FIG. 5 the pivotal air cylinder 72 carries an arm 75 adapted to engage a threadably adjustable screw 76 carried by a lever arm 77 connected to a roller carrying arm 78 pivoted at 79. The roller carrying arm carries a plurality of rollers 80 adapted to ride on the upper surface of the core co-operating and metering roll 46 when the motor bracket is swung away from the roll 46 to the solid line position of FIG. 5 and to the position of FIG. 4 to clear the arm 75 from the adjusting screw 76. This position of the motor bracket 63 locates the mandril 67 in what will hereinafter be referred to as the core loading and unloading station, a station away from the core co-operating and metering roll 46. On the other hand, when the motor bracket 63 is pulled or raised to bring the mandril 67 to the dotted line position shown in FIG. 5, adjacent to the roll 46, a position hereinafter referred to as the winding position, the arm 75 operates to lift the rollers 80 clear of the roll 46.

Co-operating with the brake drum 69 carried by the shaft 66 of which the winding mandril 67 forms a part, is a brake 81 carrying suitable brake lining 82 mounted on a rocker arm 83 connected to the piston 84 of an air cylinder 85 shown in FIG. 3. As the motor bracket swings to bring the mandril to the winding position it is arranged to contact a limit valve LV-2 to energize the motor 64 and on being swung to move the mandril to the core loading and unloading station is adapted to engage a further limit valve LV-4 for purposes as will hereinafter appear, the limit valves being diagrammatically illustrated in FIG. 5.

Figure 11:
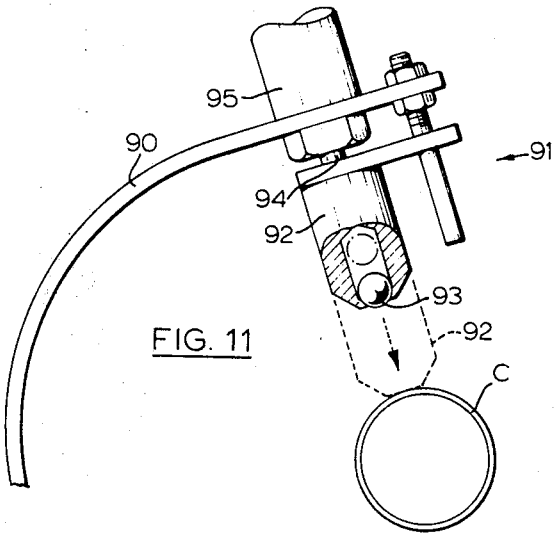
FIG. 11 is an enlarged broken-away elevational view of the core arrival sensing device associated with the mandril.
Figures 9, 10:
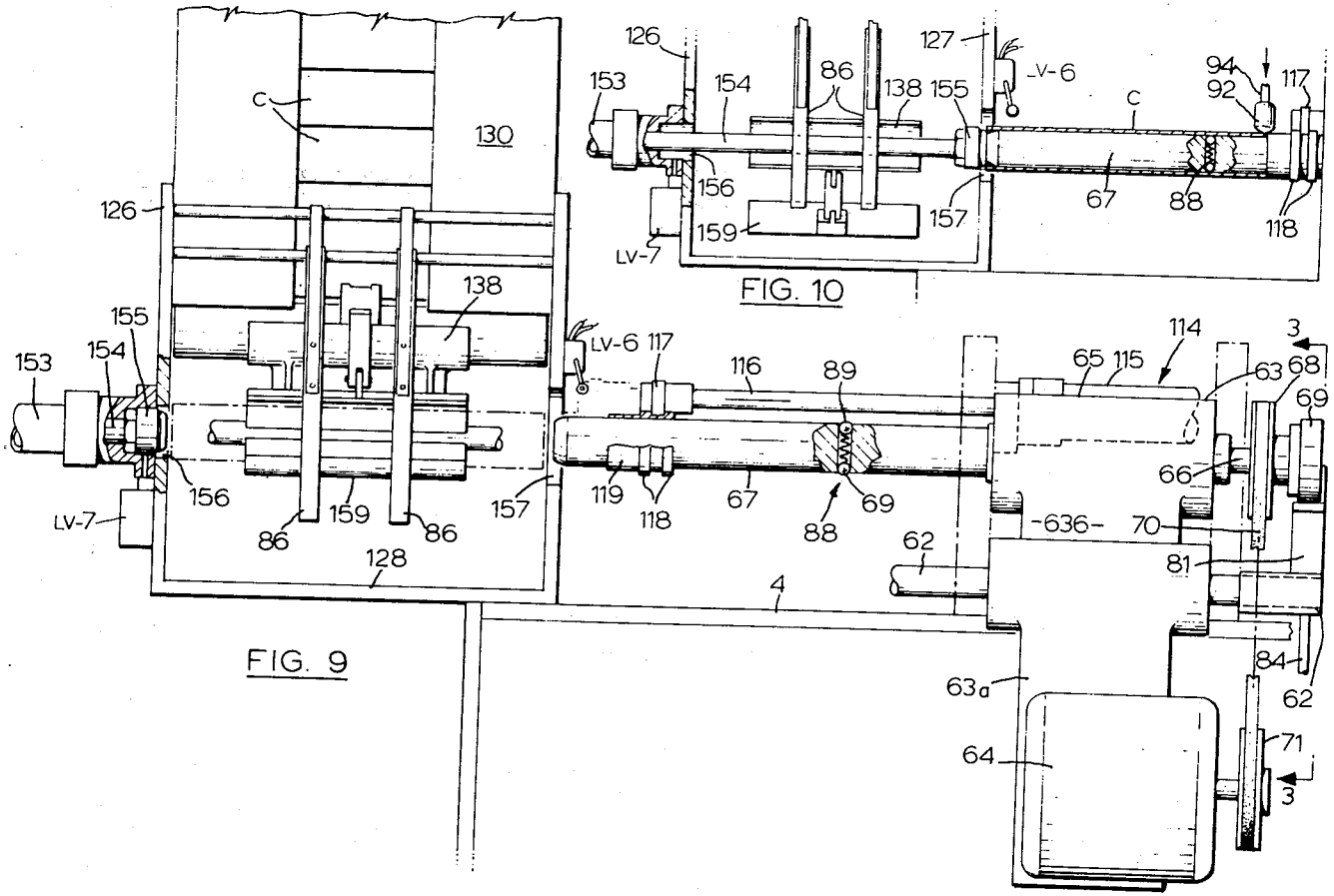
FIG. 9 is a part vertical sectional, part elevational view showing the relationship of the core transfer apparatus and the winding apparatus showing the core ejector in the process of returning following the ejection of a wound core into the waiting clam.
FIG. 10 is a view similar to FIG. 9 but showing the core loader in position immediately after delivering a fresh core from the core carrying cradle onto the winding mandril.

As illustrated in FIG. 1 and particularly in FIG. 10 the mandril 67 is adapted to have a core C on which web W from the parent roll 8 is adapted to be wound, sleeved thereon. Normally this core C is of hollow tubular construction being formed for example of spirally wound cardboard although its actual construction is immaterial from the standpoint of the present invention. As shown in FIG. 10 and also FIG. 9, the mandril 67 carries a clutch 88 in the form of a pair of spring loaded balls 89 adapted to engage the interior of the core C to provide limited torque transfer between the mandril and core. Carried on a bracket 90 is a retractable core sensing device generally designated at 91 shown diagrammatically in FIG. 10 and illustrated in FIG. 1 and particularly FIG. 11. As shown in FIG. 11 the core sensing device comprises a nozzle 92 normally closed by a ball 93 and attached to the piston 94 of an air cylinder 95. The nozzle 92 is connected in an air control circuit hereinafter more fully described and its normal position with the mandril at the loading and unloading station is that shown in FIG. 10 with the ball 93 located in the path of a core C being sleeved on the mandril. Upon the core C displacing the ball 93 to open the nozzle 92, an air signal is generated in the air control circuit hereinafter more fully described with reference to FIGS. 17A to 17G and 18 to effect commencement of the operation of the winding apparatus 2 and retraction of the core sensing device 91.

For purposes of explanation it will be understood at this point that insofar as the operation of the winding apparatus 2 is concerned, the core carrying mandril will be translated from the loading and unloading station of FIG. 1 to the winding position shown in dotted lines in FIG. 5. It will be understood that prior to the initiation of the winding apparatus, a length of web W will have been drawn off the parent roll 8 led under the idler roll 44 and over and across the top of the core co-operating roll 46 with the free web end hanging downwardly to adjacent the bottom of the roll 46 so that when the mandril reaches the winding position of FIG. 5 and FIG. 7 it will nip the web W against the roll 46 above the free end thereof.

Figure 6:
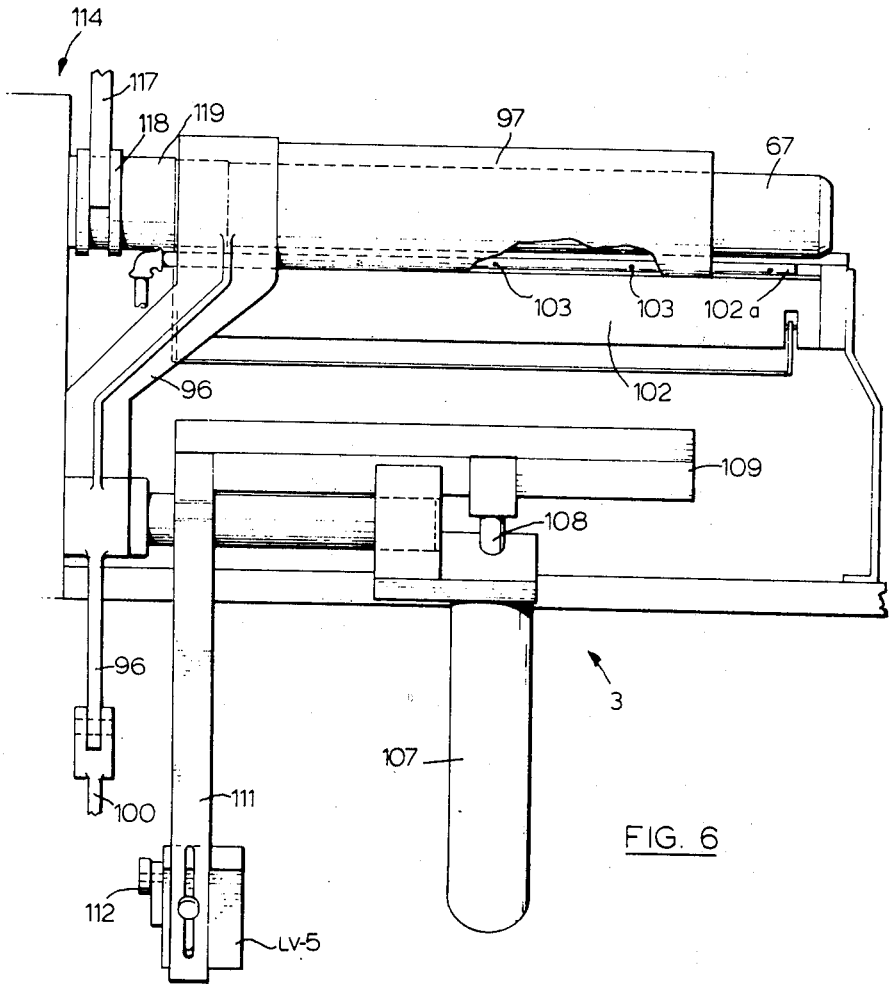
FIG. 6 is an end elevational view looking towards the mandril end of the winding apparatus and illustrating the film guide and bracket and web severing knife.
Figure 7:
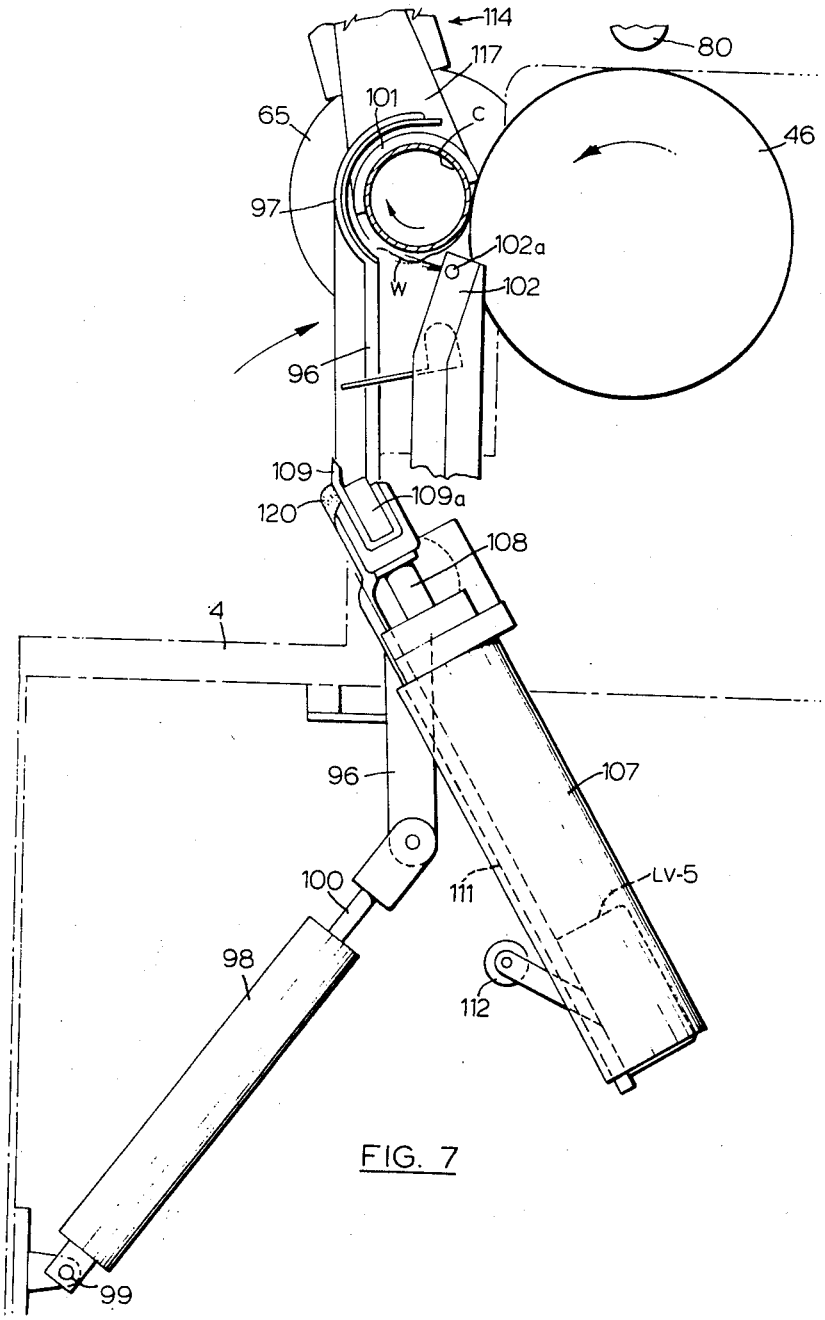
FIG. 7 is an elevational view illustrating the position of the web guide relative to the core bearing mandril at the winding position and the air jets to direct the leading edge of the web over the core co-operating roll in a wrapping motion around the core, the web severing knife being shown in a retracted position.
Figure 8:
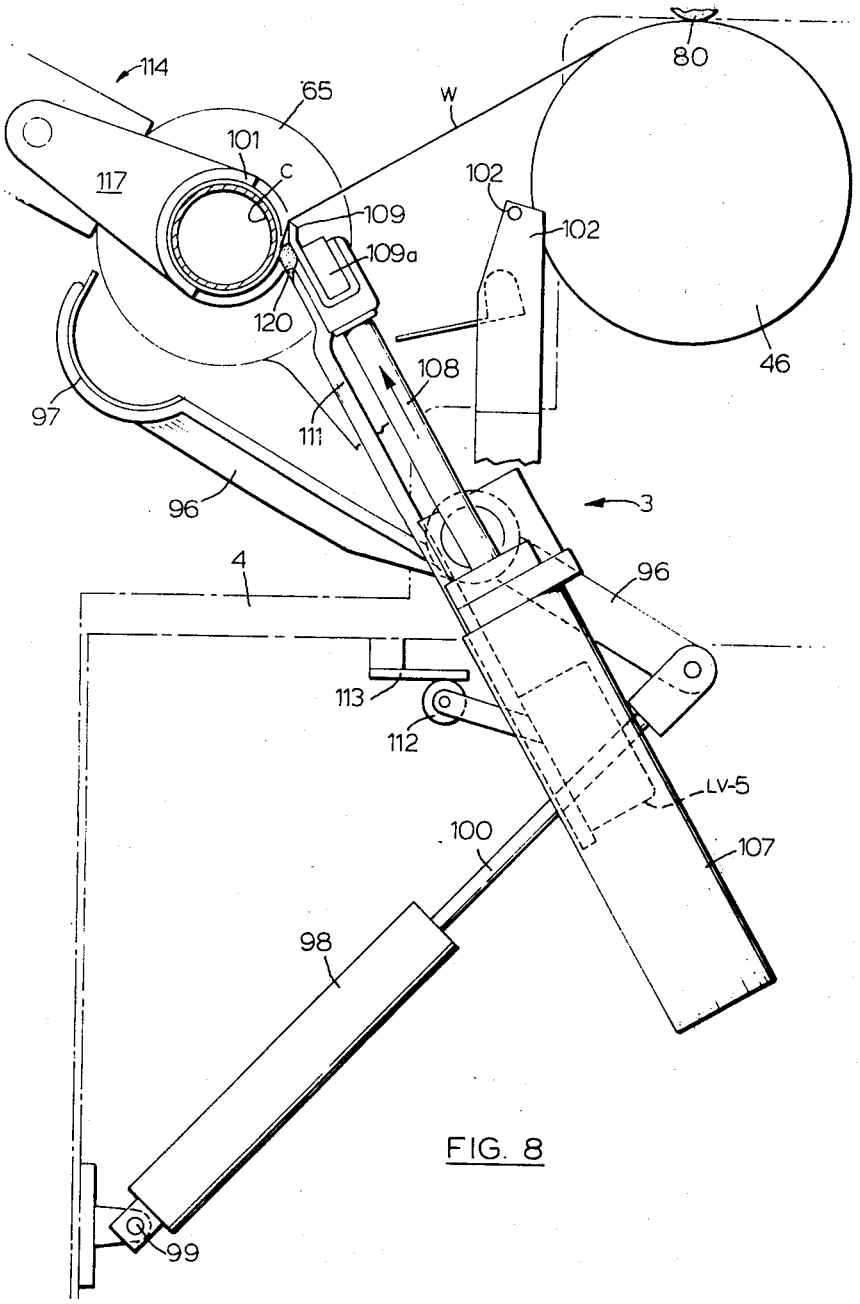
FIG. 8 is a view similar to FIG. 7 but illustrating the mandril translated to the core loading and unloading station after the core has been wound to draw out a further length of web extending between the core co-operating roll and the core and showing the web severing knife in extended severing position and the film guide swung clear of mandril and core.

As shown particularly in FIGS. 6, 7 and 8 mounted on the motor bracket shaft 62 is a lever arm 96 which carries an elongated part circular film guide 97. An air cylinder 98 pivoted at 99 has a piston 100 connected to the lower end of the lever arm 96 to swing the film guide 97 to follow the mandril from the loading and unloading station illustrated in FIG. 8 to the winding position illustrated in FIG. 7. In the drawing position of FIG. 7, the film guide 97 forms with the core C a narrow arcuate path 101 around a substantial portion of the periphery of the core. Arranged below the core carrying mandril at the winding position is a channel 102 carrying tube 102*a* running along the length of the mandril having jet openings 103 therein through which air jets initiated by the motor bracket in the up position making control valve 104 (FIG. 5) are adapted to be directed against the side of the free hanging web end away from the core to direct such web end up and through the narrow arcuate passage 101 to force such web end in a wrapping motion around the core C.

It will be understood that the air cyclinder 98 will be actuated in conjunction with the air cylinder 72 to move the film guide 97 in conjunction with the mandril 67 to the winding position for initiation of the winding. It will be also understood that the air cylinders 41, 52 and 85 will be operated to effect release of the brakes on the parent roll shaft 7, the core co-operating and metering roll shaft 47 and the shaft extension 66 of the mandril 67. Further, as the core C moves into web nipping position at the winding position, the motor bracket 63 is arranged to contact the end of the slide bar 37 to actuate same rearwardly against the laterally extending arm 35 of the drag brake 12 to lift the drag brake out of braking engagement with the parent roll brake drum 11 against the action of the spring 32, so that all brakes are off at the commencement of the winding. As previously mentioned, the arrival of the motor bracket 63 at the winding position actuates limit valve LV2 to energize the motor to drive the mandril for effecting winding onto the core C, the web W whose free end has been wrapped around the core by the jets 103.

It will be understood that since the free end of the core has not been handled by any gripping apparatus which would tend to pull or stretch or distort portions of the web end, it can be wrapped uniformly and without wrinkling, demarcation or creasing, smoothly against the core periphery at the commencement of the wind by the air jets 103. Further it will be understood that the clutch 88 provides limited torque transfer between the mandril 67 and the core C which is set so that the pull on the web W in the winding operation and particularly at the commencement of the wind where the parent roll inertia must be overcome will not tension the web so that it is stretched beyond its elastic limit or torn.

As winding proceeds, the build-up of the web on the core will push the mandril 67 away from the roll 46 while still maintaining feed pressure between the core and roll. After a small displacement, the slide bar 37 will have been moved sufficiently by the spring 32 in the drag brake system to permit the application of the drag brake 12 to the parent roll brake drum 11 by the spring 32, whose tension is set by the diameter of the parent roll as sensed by the sensor or follower roller 24 engaging the parent roll periphery. This application of the drag brake occurs by the time the parent roll has picked up speed and the drag brake then prevents overrunning of the parent roll which would cause slack in the web W giving rise to folds, creases or other nonuniformities which would show up in the wound core or roll.

When the desired length of web has been wound on the core, as determined by the position of the appropriate cam roller 59, this cam roller will operate the pivot control arm 61 by engaging the roller 60 as a result of the predetermined number of revolutions of the core co-operating and metering roll 46.

During the movement of the motor bracket 63 away from the core co-operating roll 46, as a result of web build up on the core, the motor bracket will be moved sufficiently to release a control valve 104 to interrupt air jet flow, but not sufficiently to open limit valve LV-2. It will be understood that there is sufficient clearance between the mandril and film guide to accommodate the web built up without interference from the film guide.

It will be understood that upon actuation of the control arm 61 the motor 64 will be de-energized and the brakes will be applied. In the application of the brakes, air cylinder 41 will be energized to apply the brake 13 immediately to the parent roll brake drum 11 as will the air cylinder 52 to apply the brake 49 to the metering roll shaft brake drum 48 and the air cylinder 85 will be actuated to move the brake 81 towards a braking position for braking rotation of the mandril. At the same time the motor bracket air cylinder 72 will be operated to swing the motor bracket 63 from the winding position to the loading and unloading station. In this connection it will be seen from FIG. 3 that the extension of the motor bracket operating air cylinder piston 74 will swing the motor bracket clockwise to the loading and unloading station as viewed from the position of FIG. 3 while extension of the piston 84 of the air cylinder 85 will swing the brake 81 counter-clockwise towards the braking position causing the brake 81 to meet the brake drum 69 connected to the mandril at a point intermediate between the motor bracket winding and loading and unloading positions, after which braking will commence and progressively increase until the motor bracket reaches the loading and unloading position, at which point the mandril will have been braked to a stop. As the motor bracket air cylinder 72 is operated to retract the motor bracket 63 so too is the film guide actuating air cylinder 98 to retract the film guide to the position of FIG. 8. Also as the piston 74 of the motor bracket controlling air cylinder 72 is extended to swing the motor bracket to the loading and unloading position, the arm 75 associated with air cylinder 72, which previously upon swinging the motor bracket 63 to the winding position has lifted the backlash rollers 80 off the web W led over top of the roll 46, moves out of contact with the adjusting screw 76 to allow the backlash rollers to come down and ride on the web W.

It will be seen particularly from FIG. 8 that as the mandril is translated from the winding position to the loading and unloading station, a further length of web material designated W1 is drawn off the parent roll to extend beyond the core co-operating and metering roll 46 to the wound core which is now located at the loading and unloading station.

It will be understood that the braking arrangement is such that all web feed will have come to a halt as will have rotation of the mandril when same reaches the loading and unloading station. Also, by this time, cam 59 will have cleared roller 60 of control arm 61. In connection with the parent roll braking, the lower end of the lever arm 22, (FIG. 4) which carries the core sensing and following roller 24 is provided with a cam surface 105 which is arranged to control a pressure regulating valve designated at 106 to control air pressure to the parent roll braking cylinder 41 corresponding to roll diameter which provides a measure of the parent roll inertia that must be overcome in the braking of the parent roll to a stop coincidentally with the stoppage of web feed following winding of the core and translation of the core from the winding position to the loading and unloading station so that the tension on the web on braking does not exceed the elastic limit of the web material.

Upon return of the motor bracket 63 to the loading and unloading station following winding of the core, as mentioned the motor bracket actuates limit valve LV-4 and this limit valve is arranged to effect the actuation of an air cylinder 107 having a piston 108 carrying a knife 109 heated by an electric heater 109*a* which is advanced upwardly from the retracted position illustrated in FIG. 7 to the extended position illustrated in FIG. 8 wherein it severs the web W1 immediately adjacent to the wound core with the core at the loading and unloading station. The movement of the piston 108 carries a limit valve LV-5 connected thereto by an arm 111 and the roller 112 carried by the value LV-5 is arranged to contact an abutment 113 when the heated knife 109 contacts and severs the web W1. The contact between the limit valve LV-5 and the abutment is arranged to effect immediate retraction of the piston 108 and at the same time applies a signal to a wound core ejector device generally designated at 114 to operate same to eject the wound core following knife retraction.

The ejector 114 shown in FIG. 2 and particularly in FIG. 9, comprises an air cylinder 115 having a piston 116 mounted on the hub 65 within which mandril 67 rotates. The piston 116 carries laterally extending arm 117 which engages between the ribs 118 of a sleeve 119 slidably mounted on the mandril 67. Extension of the piston 116 of the ejector will move the sleeve 119 to the left as viewed from FIG. 9 to discharge or eject the wound core axially off the end of the mandril 67 while retraction of the piston will withdraw the sleeve 119 to the right to clear the mandril for the reception of a fresh core in sleeved relationship thereon. As mentioned, the ejector is operated by retraction of the knife to extend the piston 116 to eject the wound core or roll, the ejector striking a limit valve LV-6 at the outward end of its stroke and this valve in turn is arranged to actuate the ejector to retract the piston 116 and to clear the mandril for the receipt of the succeeding fresh core.

As seen in FIG. 8, preferably a Teflon bar 120 is mounted adjacent the knife edge to support the web right up to the periphery of the wound roll or core so that on severance of the web there will be no tendency due to web backlash towards the core to crease or gather which would leave an unsightly trailing edge on the core. The backlash rollers 80 on the other hand prevent the web length W1 snapping back over the top of the core co-operating and metering roll 46, thus ensuring that the web length W1 remains on the winding side of the core co-operating roll where it will float downward under its own weight into a hanging position to constitute the hanging free web end positioned to be directed by the air jets in a wrapping action around the next succeeding core to be wound carried by the mandril arriving at the winding position.

As seen particularly in FIG. 4, mounted on the shaft carrying the backlash rollers 80 is an electrical contact member 121 having a projection 122 adapted to rest on the web W to be held by such web out of contact with the roll 46 which itself is formed of an electrically conductive material. The contact member 121 is arranged to be connected in an electrical control circuit so that in the event no web W material is present leading over the roll 46, with the motor bracket retracted away from the winding position, the winding apparatus is prevented from operating. Thus the electrical contact member 121 constitutes in effect a web sensing device to ensure the web is in position for winding before commencement of the winding operation. As a further safety precaution, an additional web sensing device 123 is preferably provided as shown in FIG. 4. This web sensing device comprises an electrically conducting roller 124 mounted on the lever arm 125 and spring urged into contact with the underside of the core co-operating and metering roll 46. The roller 124 is arranged to be connected in an electrical control circuit in a manner such that if contact between roller 124 and roll 46 is interrupted by the presence of the web due to its winding around the roll 46, the winding apparatus will be brought to a halt.

Core Feeder and Transfer Apparatus

As best seen in FIG. 1, the core feeding and transfer machanism or apparatus generally designated at 1 is mounted on a corner of the table 4 and comprises main spaced vertical side plates 126 and 127 secured in opposing relation by suitable transverse bracing 128 and supporting a core receiving hopper 129 having a vertical chute 130 leading downwardly therefrom and having a horizontal width and length corresponding respectively to the diameter and length of an individual core so that the cores are adapted to feed down the chute 130 in super-imposed relation with their axes horizontal as best seen in FIGS. 12 and 13.

As shown in FIG. 12, the cores are oriented in the hopper 129 with their axes generally horizontal and operating through the side wall of the hopper is a rocker member 131 adapted to pivot about a centre pivot 132. A suitable motor 133 connected to the rocker member by a crank arm 134 is adapted to effect oscillation of the rocker member.

The inner surface of the rocker member 131 has a pair of rounded cam lobes 135 either side of a central valley 136 and oscillation of the rocker member is adapted to effect gentle core agitation and displacement of assist core feed into the chute 130 to maintain a plurality of cores in vertically stacked relation at all times in the cute. Mounted vertically below the central axis of the chute is a main turret shaft 137 which carries a core receiving cradle 138 which is adapted to be swung upon movement of the turret shaft 137 between the position shown in FIG. 12 immediately below the lower end of the chute 130 to receive a core from the chute and a position substantially at right angles to such core pick-up position as shown in FIG. 13 to bring the core C carried by the cradle into axial alignment with the mandril 67 as shown in FIG. 10. Secured to the turret shaft 137 is a lever arm 139 to the end of which is pivoted the piston 140 of an air cylinder 141, the throw of the piston 140 being such as to move the cradle 138 through the lever or crank arm 139 between the core pick-up position with the piston extended, as shown in FIG. 12 and the core loading position with the piston retracted as shown in FIG. 13.

Mounted at the bottom of the chute 130 and off-set axially of the vertical chute axis to one side of the chute is a horizontal shaft 142 journalled in the side plates 126 and 127. As will be seen from FIG. 1, the length of the cradle 138 is less than the length of the cores and it is arranged to be located centrally beneath the chute and the cores therein when the turret is swung to bring the cradle to the core receiving position. Mounted on the shaft 142 are a pair of star wheels 143 seen in FIGS. 12 and 13 and in FIG. 15, the latter figure showing the spacing of the star wheels to locate one at each end of the cradle 138. Each of the star wheels 143 has a plurality of projections or prongs 144 being concavely recessed as at 145 between adjoining prongs. The arrangement is such that the star wheel prongs on rotation of the star wheel are adapted to successively project into the downward path of the cores C feeding down the chute 130. If rotation of the star wheels is unimpeded, the weight of the stacked cores on the lowermost core in the chute which is engaging one of the prongs projected into its path, as illustrated in FIG. 13, will cause rotation of the star wheel shaft 142 allowing downward feed of the lowermost core. The downward movement of the core will in turn rotate the star wheels so that the next succeeding projection will enter between the lowermost core being fed out the bottom of the chute and the next succeeding core which, on delivery of the first mentioned core now becomes the lowermost core in the chute. To control core feed down the chute, therefore, according to the invention, means are provided to permit star wheel rotation with the cradle in the core receiving position of FIG. 12 until the core is delivered into the cradle and to prevent rotation of the star wheel shaft when the cradle is out of vertical registration with the chute, that is, away from the core receiving position. As illustrated in FIG. 12, once the lowermost core C has been delivered downwardly into the cradle by rotation of the star wheels, the bringing of the core to a halt in the cradle will cause the core to block further star wheel rotation so that the next succeeding star wheel prong which has now entered between the core in the cradle and the lowermost core in the chute, is in a position to bar further core feed when rotation of the star wheel shaft 142 is blocked.

The means for accomplishing the blocking of rotation of the star wheel shaft 142 with the cradle out of the core pickup position is shown in FIGS. 12 and 13, and particularly FIGS. 14 and 15, and comprises a scalloped cam 146 mounted on the star wheel shaft 142 for rotation therewith. Co-operating with the scalloped cam 146 is a counter-cam 147 which is in the form of a segment of a circle and has an arcuate outer camming surface 148 adapted to co-operate with the arcuately concave co-operating camming surfaces 149 of the scalloped cam 146.

The counter-cam 147 is mounted to rotate about the main turret shaft 137 and is driven in its angular motion by a pinion 150 secured to the turret shaft and meshing with an idler pinion 151 which in turn meshes with internal gear teeth 152 formed on the inner surface of the camming surface 148. The arrangement is such that the counter-cam 147 swings in a direction counter to the direction of turret movement so that when the turret swings in a clockwise direction as seen from FIG. 12, to swing the cradle from the core pick-up position, the counter-cam which with the cradle at the core pick-up position is clear of the scalloped cam, is swung anti-clockwise to move beneath the scalloped cam to block its rotation and, in turn, rotation of the star wheel shaft 142 and the star wheels 143 to block downward core feed with the cradle out of vertical registration with the chute, the interference between the scalloped cam 146 and counter-cam 147 being shown particularly in FIG. 13 with the cradle away from the pick-up position. On cradle return, by movement of the turret in an anti-clockwise direction as viewed from FIG. 13, the counter-clam will be swung clockwise to just clear its co-operating scalloped cam surface as the cradle reaches vertical registration with the chute at which point blockage of the star wheel shaft rotation is released and the star wheels will rotate under weight of the cores to deliver a core to the cradle where upon the core coming to rest, further star wheel rotation will be blocked by the stationary core in the cradle, but before the star wheels are released by movement of the cradle and core, the counter-cam will have taken over the star wheel shaft rotation blockage.

Mounted on the side plate 126 in axial alignment with the mandril 67 with the mandril in the core loading and unloading station, is an air cylinder 153 (FIGS. 1, 2 and 9) projecting laterally from the outside face of the plate. The cylinder 153 is provided with a piston 154 having a head 155. This piston 154 is adapted to operate through an opening 156 in the side plate 126 being rectractable clear of the inside face of the side plate as illustrated in FIG. 9 so that it will not interfere with the movement of a core when same is being transferred from the core pick-up point or station to the core loading position or station. With the core moved to the core loading position, as illustrated in FIG. 13, it will be understood that the piston 154, the core and the mandril 67 at the core loading and unloading station, will all be in axial alignment and the piston is adapted to operate through the side wall opening 156 to engage the core in the cradle. As will be appreciated, the open ended cradle 138 supporting the core at the loaded position permits the stroke of the piston 154 therethrough to axially displace the core out of the cradle and through a clearance opening 157 in plate 127 and onto the mandril 67. Upon retraction of the piston 154 after having delivered the core to the position illustrated in FIG. 10, the cradle will be free to return to the core pick-up position. As more fully described in connection with the overall operation of the apparatus, the return of the piston 154 is actuated as a result of the core sensing device 91 sensing delivery of the core on the mandril and the piston in turn on returning to the position shown in FIG. 9 is arranged to operate a limit valve LV-7 to signal operation of the turret actuating cylinder 141 to return the cradle for pick-up of a fresh core.

Also mounted on the turret shaft 137 is a clam (FIGS. 1, 12 and 13) generally designated at 159 comprising an arm 160 fixed to the turret shaft in a predetermined angular relationship to the cradle 138 corresponding to the throw of the cradle in moving from the core pick-up to the core loading position. Secured to the outer end of the arm 160 is one side 161 of the clam in the form of an arcuate or part-circular plate. The corresponding opposing side 162 of the clam is mounted on an arm 163 which pivots about the turret shaft 137 so that the side 162 can be swung towards and from the side 160 to close and open the clam respectively. The movable side wall 162 of the clam is connected to the cradle 138 by means of links 164 and 165 connected respectively to the clam side and the cradle and to a draw bar 166 to which is attached the piston 167 of an air cylinder 168 pivotally connected to a lug 169 projecting from a hub 170 secured to the turret shaft 137.

The arrangement is such that the cradle in the core receiving position as illustrated in FIG. 12, the clam is in a position in axial alignment with the mandril when same is at the core unloading position and the clam has been actuated by the air cylinder to open. As shown in FIG. 9, with the clam in this position it is adapted to receive a wound core or roll from the winding apparatus as delivered thereto by the ejector 114. Again, as hereinafter more fully described in connection with the control circuit, the retraction of the ejector 114 through operation of the limit valve LV-6 effects a closing of the clam on the wound core received through operation of the air cylinder 168 and rotation of the turret to bring a fresh core into the loading position and to move the closed clam carrying a wound core to a dependent tabbing position illustrated in FIG. 13 and more particularly in FIG. 16.

In this connection, it will be appreciated that the wound core on the mandril having had the web severed immediately adjacent to the core with the core stationary, will always have the trailing edge of the web in the same orientation relative to the core prior to wound core or roll ejection. This relationship will be maintained by the pure axial movement of the wound roll off the mandril into the open clam, the trailing web edge being exposed at the open face or mouth of the clam. In turn, the immediate clamping of the clam will ensure that roll or wound core rotation is precluded during transfer of the core to the tabbing position so that the trailing edge T of the web will always be exposed through the open face of the clam at precisely the same orientation each time for tabbing.

To ensure maintenance of the core in the cradle during movement to the loading position and the wound core in the clam at the unloading position, safety bars 86 are provided and urged by springs 87 towards the open faces of the cradle and the clam when same are at the loading and unloading station.

Tabbing Mechanism

The tabbing mechanism generally designated at 3 is illustrated in FIGS. 12, 15 and 16 and comprises essentially a cog wheel device 171 for feeding tabs 172 carried on a backing strip or web 173 to a pick-up position designated at 174 and a picker head 175 for picking up a tab 172 off the carrier strip 173 and delivering same to be applied bridging across the trailing edge T of a web on a wound core held in the clam 159 with the clam at the tabbing position.

As seen from FIG. 16, the cog wheel 171 is mounted for rotation on an axle 176 extending in a direction perpendicular to the axis of the turret shaft 137 and carried by a bar 177 extending in a direction parallel to the turret shaft.

The cog wheel 171 has a series of cog teeth 178 running around the periphery thereof at the front face and adjacent this face the cog wheel is provided with a series of pin projections 179 running around the outer periphery thereof. Adjacent the opposite face the cog wheel is provided with a series of holes 180 also extending peripherally there-around, the holes leading from the outer face of the cog wheel to an inner annular chamber 181 shown particularly in FIG. 12.

The tabs 172 are of elongated configuration and have a main section 182 provided on one face with a pressure sensitive adhesive by means of which the tab is adapted to be temporarily attached to the carrier strip 173 for release therefrom under vacuum pressure to be carried by the picker head 175 to the tabbing position wherein the adhesive carrying face 183 is forced into contact with the web material W on the wound roll to adhere thereto in bridge across the trailing edge T.

At the end of the main section 182 of the tab, is a short tab length 185 without adhesive and adapted to form a finger grip by means of which the tab can be lifted to first break the seal down of the trailing edge T of the wound roll and then while a portion of the main section 182 is still adhered to the trailing portion of the wound web, to initiate unwinding of the web.

The carrier strip 173 is provided with a first longitudinal roll of holes 186 extending parallel to one longitudinal edge and adapted to co-operate with the pins 179 of the cog wheel 171 for positive tab carrier feed.

The tabs 172 are mounted on the carrier strip 173 with their adhesive carrying faces 183 downwardly and temporarily adhered to the strip as explained in a longitudinal row in which the tabs extend transversely of the length of the carrier strip with the longitudinal centre line of each tab lining up with one of the holes 186. The carrier strip or tape is also provided with a second longitudinal roll of holes 187 which also line up with the centre line of the tabs 172 and register with the holes 180 in the cog wheel.

The tab carrying strip or tape 173 is carried on a reel 188 supported by a bracket 189 at one side of the feed mechanism being mounted on the plate 127. A length of tape drawn off from the reel 188 is led over the cog wheel 171 with the cog wheel pins 179 meshing in the tape holes 186. The tape is then led past the pick-up position 174 where the picker head is adapted to pick-up tabs from the tape and then through the nip and over an idler roll 190 for discharge.

Rotational movement of the cog wheel 171 is achieved by means of a pawl 191 engaging with the cog teeth 178 and operated as a result of the motion of the picker head 175, being synchronized therewith as hereinafter more fully explained.

The picker head 175 is pivotally connected to a crank arm 192 as shown particularly in FIG. 16 and this crank arm is secured to a shaft 193 mounted to rotate between the plate 126 and a hanger bar 194 as seen in FIG 15. The shaft 193 is rocked through a rack and pinion arrangement in reponse to turret operation. In this connection as seen particularly in FIGS. 12, 13 and 16, the hub 170 fixed to the turret shaft 137 carries an arm 195 to the endd of which is pivotally connected a rack bar 196 which engages a pinion 197 carried on a hub 197*a* rotatably mounted on the shaft 193, a guide saddle 198 in the form of a channel having a pair of spaced legs 199 pivoted on the shaft 193 and bracing the pinion 197 serves to maintain the rack in engagement with the pinion during reciprocal rack movement under throw of the arm 195 in response to turret movement. Connected between a bar 233 fixed to the pinion hub 197*a* and an arm 192*a* anchored to picker rocker shaft 193 is a spring bar 234 to provide a resilient drive between the pinion and picker head for a purpose hereinafter explained.

Attached to the picker head 175 is a longitudinal rod 200 which is slidably received in a sleeve 201 having leg portions 202 securing the sleeve to a shaft 203 journalled for rotation between the support plates 126 and 127 as shown in FIG. 15. As illustrated in FIG. 16 and then FIG. 12, movement of the picker head from the tabbing station under throw of the crank arm 192 in response to rotation of the pinion 197, causes the guide sleeve to rock from a horizontal position to an inclined position inclined downwardly towards the picker head and to then return to a horizontal position as the rod 200 attached to the picker head slides therethrough. This rocking of the guide sleeve 201 causes a rocking of the shaft 203 which in turn rocks an arm 204 secured to the shaft 203. The pawl 191 is pivotally connected to the end of the arm 204 at a point outwardly from the face of the cog wheel 171 carrying the cog teeth 178, the pawl being inclined from its point of support to contact the cog teeth 178 at one side of the cog wheel as shown in FIGS. 15 and 16.

As shown in FIG. 16, as the picker head 175 is swung from the solid line tabbing position to the intermediate dotted line position, the rocking of the shaft 203 as a consequence of the rocking of the sleeve 201 will cause the arm 204 to move the pawl 191 which is in engagement with the cog teeth 178 upwardly from the solid line position to the dotted line position to advance the cog wheel, the pawl and cog wheel teeth being in positive engagement during this movement of the picker head. On the picker head swinging from the dotted line position of FIG. 16 to the pick-up position shown in FIG. 12, it will be understood that the guide sleeve 201 will be returned to a horizontal position which will rock the shaft 203 in a direction to swing the arm 204 in a counter-clockwise direction as shown in FIG. 12 and 16 to draw the pivoted lower end of the pawl downwardly and since movement of the pawl in this direction will permit it to ride over the cog wheel teeth, no cog wheel advance is effected and the upper end of the pawl comes to a rest at a lower position corresponding to the solid line position shown in FIGS. 12 and 16 ready for futher cog wheel rotation and tape and tab advance on movement of the picker head.

It will thus be seen that the cog wheel is advanced as a result of the picker head moving from the tabbing position shown in solid lines in FIG. 16 to the pick-up position shown in FIG. 12 and vice versa, so that the throw of the pawl 191 for each rocking of the shaft 203 is made such that it advances the cog wheel one half of the distance between the centre lines of adjoining tabs 172.

As shown in FIG. 12, the relationship between the core feeding and transfer mechanism 1 and the tabbing mechanism 3 is such that when the turret operating cylinder 141 is operated to extend its piston 140 to swing the cradle 138 to the core receiving position shown in FIG. 12, the arm 195 will have swung downwardly to move the rack bar 196 downwardly to swing the picker head to the tab pick-up position.

The picker head 175 is provided with a suitable port arrangement 205 through which vacuum from a suitable vacuum source can be applied and rotation of the shaft 193 is adapted to operate through a bar 206 fixed thereto, a limit valve LV-10 to effect the application of vacuum through the upper face 208 of the picker head as permitted by the port arrangement 205.

At the pick-up position 174 it will be appreciated that the centre line of the upper face 208 of the picker head will be in registration with the centre line of the tab to be picked up, with such upper face in contact with the outer nonadhesive carrying face of the tab and the vacuum will be sufficient to strip the temporarily adhered tab from the carrier 173 so that the tab is now anchored to the picker head for transfer to the tabbing station designated at 209. To further assist in the stripping of the tab 172 as illustrated in FIG. 12, a nozzle 210 is arranged to direct an air blast through the registering holes 180 and 187 in the cog wheel and tape against the underside of the tab.

Preferably, to ensure positive tab pick-up it is desirable to have the initial withdrawl movement of the picker head away from the tab pick-up position take place slowly so that the tab will not be left behind, yet for high speed operation of the apparatus the transfer of the tab from the pick-up position to the tabbing station must be rapid. To provide this action the limit valve LV-10 operated by bar 206 fixed to shaft 193 is also arranged to actuate a small air cylinder 235 whose piston 236 moves slowly against the bar 206 to move shaft 193 slightly anti-clockwise as seen in FIG. 12, as permitted by the resiliency of the spring drive bar 234 connecting shaft 193 to the pinion 197. This slight movement of shaft 193 withdraws the picker head slowly down a slight distance from the tab pick-up position so that the tab is picked up without abrupt picker head movement. This action occurs while the turret is stationary with the clam awaiting the completion of the winding of a core and its delivery to the clam.

The operation of the turret cylinder 141 to retract the piston 140 to swing the cradle from the pick-up position of FIG. 12 to the core loading position of FIG. 13 in response to the delivery of a wound core or roll into the open clam as previously described, swings the turret shaft 137 in a clockwise direction as viewed in FIG. 12 to raise the rack bar 196 from the position of FIG. 12 to the position of FIG. 13 causing the picker head 175 to move from the pick up position 174 to the tabbing position or station 209 while carrying a tab 172 anchored tightly against its upper face 208. At the same time as previously explained, the clam 159 will have closed on the wound core and will have swung the wound core to the tabbing station 209.

As seen particularly from FIG. 16, it will be appreciated that due to the throw of the picker head 175 under the action of the crank arm 192, the picker head will be travelling essentially vertically as it reaches the tabbing station 209 while the wound core or roll will be moving angularly in the clockwise direction, with the trailing edge T in the trailing position with reference to such angular motion. The net result is that as the adhesive carrying face 183 of the tab contacts the web material on the core in the vicinity of the trailing edge T, any relative angular movement of the wound core and the tab will have the effect of drawing the end of the web more tightly about the core, at which time the full adhesive carrying face 183 will be secured to the wound core bridging across the trailing edge T and with the finger tab portion 185 of the tab at the side of the trailing edge T such that on pulling of the finger tab its first action will be to lift off the tab portion adhered to the web material behind the trailing web edge T, that is the portion of the tab that seals the trailing edge down to the under layer, to free the trailing edge of the web, after which further pull on the tab 185 will initiate the unwinding of the web from the roll.

In order to permit the application of the tab to the wound roll at the tabbing station 209, vacuum is cut off from the picker head face 208 and this is accomplished through the swinging of the turret down to bring the cradle to the core loading position by means of the bar 206 secured to the shaft 193 striking a limit valve LV-1 illustrated in FIG. 12. LV-1 is arranged not only to cut off the application of vacuum to the face 208 but to apply an air jet through such face to assist in the application of the tab to the wound core. As hereinafter more fully explained, LV-1 is also arranged to operate the core loading cylinder 153 to load a core onto the mandril which, on being received on the mandril is sensed by the core sensing device 91 which effects return of the core loading piston 154 which on return operates the limit valve LV-7 to effect upward movement of the turret to return the cradle 138 to the core pick-up position while simultaneously effecting opening of the clam 159 to drop out the tabbed wound core and return of the clam to the wound core pick-up position while the picker head is returned to the tab pick-up position.

Air Circuit

With reference to the schematics of the power valves P1 to P7 shown in FIGS. 17A to 17G and the air schematic circuit of FIG. 18, it will be seen that the main air supply designated at 213 in FIG. 18 is connected through a shut-off valve 214, filter 215, pressure regulator 216, lubricator feed 217 to the power valves P1 to P7, as controlled by the air control circuit generally designated at 218, fed through filter 219, regulator 220 and further filter 221 connected to the main air supply 213 by the line 218*a*.

Conditions at the start of operations of the machine are that the main air supply 213 is on as is the controlled supply and all electrical circuits are on, the motor bracket 63 is away from the core co-operating and metering roll 46 to locate the mandril 67 in the core loading and wound roll unloading position. All brakes are on and the ejector 114 is retracted. The turret is down to locate the cradle 138 in axial alignment with the mandril 67, the hopper or magazine 129 is full, the parent roll 8 is full and in position, the vacuum is off, the severing knife 109 is retracted and is heated to cutting temperature and the winding motor is off.

The operation will first be described with reference to a single cycle in which a selector valve S in line L3 in FIG. 18 is in the solid line position maintaining the right hand end of line L3 non-conducting. The operator first places a core in the cradle 138 and pushes a start button PB1 in line L3 connected to the air control circuit line 222. Depression of the start button PB1 provides an air path through the normally conducting flow path of a standard spring loaded relay valve RV5 in line L3 through a bypass line 223 to line L4 and because the turret is down making the limit valve LV1 pass through this limit valve and therefore the normally conducting flow path of latch type relay valve RV-1 in line L4. This supplies control air to the detent spool type air flow relay or power valve P4 indicated for convenience by the square block P4A in line L4. Similar designations with respect to similar air flow control devices hereinafter appear, the square blocks representing detent devices and the circles representing spring loaded devices. Control air delivered to said pilot port P4A will shift the valve P4 from the position illustrated in FIG. 17D to the right where it will remain until a signal is received at the pilot port P4B and pilot port P4A is exhausted. This shifting of the valve P4 will reverse the position of the core loading cylinder piston 154 to advance the piston to deliver the core C axially onto the mandril 67. At the same time the piston 94 controlling the rectractable core sensing device 91 will be extended to advance the core sensing device into a position to detect the delivery of the core C onto the mandril.

At the same time pilot port A of latch type relay valve RV4, designated as RV4A, line L5, will receive an air signal to render non conductive the normally conducting passage of RV-4 in line L27 and to render conducting the normally non-conducting passage of RV-4 in line L28. At the same time the pilot port B of power valve P7 (shown as P7B) in line L6, will receive an air signal to operate the valve so that the vacuum is shut off and pressure air is supplied, as illustrated in FIG. 17G.

The arrival of the core C into position on the mandril 67 will release the ball 93 to open nozzle 92 allowing bleeding of pilot port B of the jet sensing relay valve JRV1 in line L30 and since the normally non-conducting flow passage of relay valve RV-4 in line L28 has been rendered conductive, air flow through relay valve RV-4 and through the pressure regulator R in line L29 will operate pilot port A of jet sensing relay valve JRV1 in line L28. The operation of this relay valve will render the normally nonconducting passage of jet sensing relay valve JRV-1 in line L7 conducting to operate the A pilot port of detent spool type air flow relay valve RV1 (shown as RV1A) which will render conducting the normally non-conducting passage of relay valve RV-1 in line L10 which in turn applies air from the control circuit line 222 to the pilot port of spring loaded power valve P1 which is normally spring-urged to the right, as illustrated in FIG. 17A, but which on receiving an air signal at the pilot port at the right hand end moves to the left until such signal is removed at which time it is returned by the spring 224 back to its normal position illustrated in FIG. 17A. Operation of power valve P1 causes reversal of the air flow to the motor bracket cylinder 72 and the film guide cylinder 98 to effect movement of the motor bracket to translate the mandril 67 with the core C thereon into contact with the core co-operating roll 46 and to cause the film guide 97 to follow the mandril into film guiding position. As the same time, spring loaded power valve P2 is energized to move same from the position of FIG. 17B where it holds the parent roll brake 13, the core co-operating and metering roll barke 49 and the mandril or motor brake 81 on to the left to release these brakes. At the same time a signal is sent through shuttle valve 226 in line L9 to the pilot port B of power valve P4 (shown as P4B) to retract the core loading portion 154 which is permitted because the naturally conducting passage of relay valve RV-1 in line is now open or connected to atmosphere as a result of the previous delivery of air to port RV1A in line L7 and to retract the core sensing device 91. These retractions take place immediately upon energization of the pilot port A of valve RV1 so as not to interfere with the upward movement of the motor bracket which moves subsequently to the clearance of these retracting devices from its path of movement. When the core loading piston 154 is fully retracted it makes limit valve LV-7 in line L12 conducting which then delivers air through to pilot end A of the power valve P5 (shown as P5A) to move the turret up to bring the cradle 138 into vertical registration with the chute 130 to pick up a fresh core and to operate the clam piston 167 to open the clam, the arrangement being such that the clam opens immediately on receipt of the signal at P5A so that a tabbed wound core can drop out immediately to a conveyor or tray while motion of the turret is delayed and moves more slowly as regulated by the normal air controls in the head of the cylinder.

As the turret swings up, LV10 in line L15 is made to apply a signal to the pilot port A of power valve P7 to apply vacuum to the picker head 175 which has been moved through swinging of the turret as previously described to the tab pick-up position, and to direct air through nozzle 210 in the cog wheel 171 to effect the stripping of a tab from the carrier web and its pick up by the picker head. At the same time air is fed to cylinder 235 to effect the small initial retraction of the tab carrying picker head from the tab pick-up position.

When the motor bracket is translated to bring the mandril into the winding position limit valve LV-2 in line L13 is made conducting, applying air to the pressure switch PS1 which is normally spring loaded to return and this pressure switch energizes an electrical contact to energize the winding motor 64 to commence the winding operation. At the same time pilot port A of relay valve RV2 (shown as RV2A) is energized to render the normally non-conducting passage of RV-2 in line L20 conducting, although the line is not conducting at this time because limit valve LV4 in line L20 is only made when the motor bracket is down at the loading and unloading station. When the metered amount of web W is wound on the core, ganged limit valve LV-3 is tripped to provide air flow through line L19 and shuttle valve 227 in line L17 to pilot port B of relay valve RV1 (shown as RV1B) which reverses this valve to again render the normally conducting passage of RV-1 in line L4 conducting. The cutting off of air in line L10 causes power valve P1 to move under the action of its spring 224 to the position of FIG. 17A to move the motor bracket to the core loading and unloading position and to retract the film guide. At the same time, power valve P2 is operated by its spring 225 to move to the position shown in FIG. 17D to apply the parent roll, core co-operating and metering roll, and mandril brakes.

While air is cut off in line L12 to outlet port A of power valve P5 (shown as P5A) because this is a detent or latch type valve, it will not move until it receives a signal at pilot port B and the turret remains up. However, immediately air is cut off in line L13 the winding motor is de-energized and of course the line is further interrupted by the opening of the passage of the limit valve LV2 as the motor bracket returns from the winding position to the loading position. Again, while air is cut off in line L13 to Port A of detent relay valve RV2, this relay valve does not operate until a signal is received at pilot port B designated at RV2B in line L23.

Although the normally conducting passage of RV-1 in line L4 has been rendered again conducting, air does not flow through to pilot port A of power valve P4 because the turret is still up and LV-1 is non-conducting.

Upon arrival of the motor bracket to the down or unloading position, LV-4 in line L20 will be made conducting and since the normally non-conducting passage of RV-2 in this line has just been rendered conductive and the passage of RV-3 in this line is normally conductive, air will feed to the pilot port of spring loaded power valve P6 shown in FIG. 17F to move this valve against the action of its spring 228 to reverse the air flow to the knife operating cylinder 107 to advance the knife to the web cutting position. As the knife moves upwardly to the web cutting position it operates ganged limit valve LV-5 in lines L21 and L22 to render line L21 conducting while rendering line L22 non-conducting. Line L21 then delivers air through to the pilot port A of detent type relay valve RV3 (shown as RV3A) which causes opening of the normally conducting passage of RV-3 in line L20 and closing of the normally open passage of RV-3 in line L22. The opening of line L20 allows the spring 228 of the power valve P6 in FIG. 17F to return the valve to the position illustrated to retract the knife, releasing LV-5 in line L21 to interrupt flow in this line and closing same in line L22 to permit flow in this line which because the normally open passage of RV-3 in this line is now conducting, directs air to spring loaded powr valve P3 to operate same against the spring 229 to reverse the air flow from that shown in FIG. 17C to cause the ejector piston 116 to eject the wound core into the waiting open clam. At the same time, the pilot port B of relay valve RV2 receives a signal through shuttle valve 230 in line L23 to again render the passage of RV2 in line L20 non-conducting preparatory to the return of the flow path of RV-3 in this line to its normal conducting conditionn. Upon the ejector reaching its fully extended position, it makes ganged limit valve LV6 in lines L26 and L27 closing line L26 and opening line L27. The closing of line L26 operates pilot port B of relay valve RV3 in line L25 (shown as RV3B) to return the flow passage of RV-3 in line L20 to its conducting condition and the flow passage of RV-3 in line L22 to its normally non-conducting condition. At the same time, pilot port B of relay valve RV4 (shown as RV4B) is operated to return the flow passage of RV-4 in the line L27 to its normally connducting condition and the flow passage of RV-4 in line L28 to its normally non-conducting condition.

The opening of the flow passage of RV-3 in line L22 causes the ejector power valve P3 to return under action of the spring 229 to the position shown in FIG. 17C to return the ejector which in turn opens limit valve LV-6 in line L26 and closes same in line L27. Line L27 is now conducting and provides a signal to the B pilot port of power valve P5 (P5B) to return the valve to the position shown in FIG. 17E to rotate the turret in a delayed movement (as explained above) to move the cradle carrying a fresh roll into axial alignment with the mandril which is now at its core receiving or loading position and to swing the clam in which the wound core or roll has been received to the tabbing position, the clam having first been closed on the wound core prior to turret movement by the immediate retraction of the roll clamp cylinder piston 167.

The cycle has now been completed and for single cycle operation start of the new cycle can be initiated by operating the push button PB1. Alternatively, if the machine is to be operated automatically, the selector valve S is operated to the dotted line or closed position in line L3 in which case the operation of the pushbutton PB1 energizes spring loaded relay valve RV5 in line L3 to close the normally open passage of RV-5 in line L4 to provide a bypass around pushbutton PB1 so that when the turret moves down to the core loading position in which the core is in axial alignment with the mandril, a signal will be delivered to the pilot port A of the core loader and the core sensor pilot port A of power valve P4 and the relay valve RV-4 and the pilot port B of power valve P7 and the cycle previously described will be repeated and will continue to be repeated, rendering the complete apparatus fully automatic.

The web sensing electrical contacts 121 and 123 associated with the core co-operating and metering roll 46 are arranged to actuate the electrically operated relay valve ERV-1 to open the normally passing flow path in line L3 so that the apparatus will not recycle and to close the normally closed flow path in line L18 to provide a signal corresponding to the signal delivered upon the required length of web being wound. Thus the functioning of the apparatus is interrupted in the event either that no web is present or the web winds around the core co-operating and metering roll 46.

Also an auxilliary control circuit is provided through line 231 in FIG. 18 operated by reset pushbutton 232 to deliver air temporarily through lines L8, L16 and L24 and shuttle valves 226, 227, 230 and 230A to pilot ports P4B, RV1B, RV2B, RV3B and RV4B to see that their respective flow control elements or spools are all returned to the proper position for correct machine cycling.

While the preferred embodiment of the apparatus and the various components thereof have been particularly described and illustrated, it will be understood that various modifications and alterations may be made within the spirit of the invention. For example, the required relative movement of the mandril 67 and core co-operating roll 46 between the web nipping or winding position and the separated position for loading and unloading is achieved most simply by the preferred arrangement disclosed of having the mandril movable although it will be appreciated that such relative movement can also be effected by having the core co-operating roll movable or by having both the mandril and core co-operating roll movable with the appropriate rearrangement of the controls. it is intended that these and other modifications and alternations as will be apparent to those skilled in the art may be made without departing from the scope of the appended claims.

I claim:

1. Core feed means for a winding apparatus having a core receiving station for receiving an axially fed core, said core feed means comprising a cradle adapted to accept and support an individual core, means mounting said cradle for movement perpendicular to the axis of a supported core between a core pick-up position and a core loading position in which the cradle is adapted to support a core therein in axial alignment with the winding apparatus loading station and core delivery means operating through the cradle and axially of a core supported therein with said cradle stationary at said loading position to deliver a core to the winding station.

2. Core feed means as claimed in claim 1 including a core receiving hopper, a core chute leading from said hopper to a point immediately adjacent to said core pick-up position for delivering cores seriatim from the hopper to said cradle, and means actuated by the movement of said cradle away from said pick-up position to block core delivery from said chute and actuated by the movement of said cradle to said pick-up position to release said core delivery block.

3. Core feed means as claimed in claim 1 including a core receiving hopper, a core chute for delivering cores seriatim under gravity leading downwardly from said hopper to a point immediately above said cradle, with said cradle moved to said core pick-up position, star wheel means presenting a plurality of prong elements rotatably mounted at one side of the lower end of said chute so that said prong elements are presented successively into the path of the successively arriving lowermost core in said chute on core feed down the chute, means actuated by the movement of said cradle away from said pick-up position to block star wheel rotation and by arrival of the cradle at the said pick-up position to release said star wheel means for rotation whereby said star wheel means is rotated under core weight to allow the lowermost core in said chute to drop into and come to rest in said cradle and to bring the next successive star wheel prong below and in the path of the next succeeding core in said chute, the arrested core in said cradle constituting a blocking device in the path of said next successive star wheel prong preventing further star wheel rotation while said cradle remains in said pick-up position.

4. Core feed means as claimed in claim 3 in which said means mounting said cradle for movement between said core pick-up and core loading positions comprises a turret.

5. Core feed means as claimed in claim 4 in which a scalloped cam is mounted to rotate with said star wheel means, said scalloped cam having a plurality of scallops corresponding to the number of prongs on said star wheel means and counter cam means are provided actuated by movement of said turret to move into interference with a scallop of said scalloped cam to block rotation thereof during cradle movement away from said pick-up position and to clear the scallops of said scalloped cam when said cradle is at said pick up position.

6. Core feed means as claimed in claim 1 in which said means operating through said cradle for delivering a core to the winding apparatus comprises air cylinder means, means responsive to the arrival of said cradle at said loading position to extend said air cylinder means for core delivery, means operable as a consequence of core delivery to retract said air cylinder means, and means operable as a consequence of the retraction of said air cylinder means to actuate said means mounting said cradle to move said cradle to said pickup position.

7. Core feed means as claimed in claim 6 in which said means mounting said cradle comprises a turret, and air cylinder means are provided to operate said turret, said turret operating air cylinder means being actuated by the retraction of said core delivery air cylinder means to move said cradle from said loading position to said pick up position and means for operating said turret operating air cylinder means to move said cradle from said pick-up to said loading position.

8. Core feed means for a core winding apparatus having a loading station for receiving an axially fed core and an unloading station from which a wound core is adapted to be axially ejected, said core feeding means comprising a turret, an open ended cradle adapted to accept and support an individual core while allowing axial core transfer endwise thereof mounted on said turret for movement between a substantially upright core pick-up position and a loading position displaced therefrom in which the cradle stationary is oriented to support a core therein in axial alignment with the windng apparatus loading station, and core delivery means operating from a position clear of said cradle endwise through the said cradle and axially of a core supported therein with said cradle at said loading position to deliver a core and to thereafter return to its said position clear of said cradle.

9. Core feed means as claimed in claim 8 including a core receiving hopper, a core delivery chute leading downwardly from said hopper to a point immediately above said cradle when same is at said pick-up position for delivering cores in succession from said hopper under gravity feed, the length of said cradle being less than the length of core to be fed and said cradle in said pick-up position registering lengthwise with the central portion of the lowermost core in said chute, a pair of spaced star wheels fixed on a shaft rotatably supported at one side of the lower end of said chute, said star wheels spanning said cradle when same is at said pick-up position and presenting a plurality of prongs adapted on star wheel rotation to successively move into the path of each successive core arriving at the lowermost point of said chute immediately above the cradle, the weight of the cores being such that cores accumulated in said chute will effect star wheel rotation with said shaft free to rotate, means blocking said shaft against rotation and preventing downward movement of the lowermost core with said cradle out of said pick-up position and releasing said shaft for rotation with the cradle at said pick-up position.

10. Core feed means as claimed in claim 9 in which said shaft carries a scalloped cam having the same number of scallops thereon as said star wheels have prongs, and a counter cam actuated by movement of said turret is arranged to successively interfere with the successive scallops on said cam for each sucessive cradle movement cycle away from said core pick-up position to said core loading position and return, said countercam being moved clear of scalloped cam with said cradle in said pick-up position.

11. Core feed means as claimed in claim 8 provided with a clam device mounted on said turret and movable therewith between a position in axial alignment with the unloading station of the winding apparatus when said cradle is at said pick-up position and a dependent position removed from the unloading station when said cradle is in said loading position, said clam device having relatively movable side walls extending parallel to the axis thereof, means for effecting relative side wall movement operable to spread said side walls apart with said clam in unloading station alignment to receive an ejected wound core and to close said side walls to clamp a wound core received therein during movement of said clam to said dependent position.

12. Core feed means as claimed in claim 11 in which air cylinder means are provided connected to said turret to operate said turret, an air control circuit to control said air cylinder means and first control means included in said air control circuit operated by the return of said core delivery means to said position clear of said cradle with said cradle at said loading position and said claim at said dependent position to effect turret movement to move said cradle to said pick-up position and said claim to the aligned unloading station position and second control means included in said air control circuit for reversing turret movement when a wound core is ejected into said clam.

13. Core feed means as claimed in claim 12 in which said clam has a fixed side wall and a swingable side wall, and the means for effecting relative side wall movement comprises air cylinder means connected to said swingable side wall, said latter air cylinder being controlled by said air control circuit to swing said swingable side wall to clamp a wound roll coincidental with the actuation of said second control means to reverse turret movement and to release a clamped wound roll while said clam is in said dependent position coincidental with the operation of said first control means by the return of said core delivery means.

14. Core feed means as claimed in claim 13 in which said core delivery means comprises an air operated ram controlled by said air controlled circuit, third air control means included in said air control circuit to operate said ram upon said turret being moved to bring said cradle to said loading position from a position clear of said cradle through said cradle to deliver a core carried thereby to a winding apparatus and a fourth control means included in said air control circuit responsive to the delivery of a core to effect return of said ram to said position clear of said cradle.

15. Core feed means as claimed in claim 11 having means to apply an end tab to a wound core while same is clamped in said clam with said clam at said dependent position which constitutes a tabbing position.

16. Core feed means as claimed in claim 15 in which said clam at said unloading station aligned position is oriented on its side to receive an ejected wound core with the trailing edge of the web on the core facing outwardly between the clam side walls and at said dependent position facing downwardly to present the trailing edge of the web wound on the core at the underside of the periphery of the core.

17. Core feed means as claimed in claim 16 in which said means to apply an end tab to a wound core clamped in said clam comprises a picker head means operated by the movement of said turret to move said picker head to a tab pick-up position away from the dependent position of said clam on movement of said turret to move said cradle to said pick-up position and said clam to said position in axial alignment with the unloading station and to move said picker head to a tabbing position on movement of said turret to move said cradle to said loading position and said clam to said dependent tabbing position, and means for feeding tabs to said pick-up position to be picked up by said picker head, said picker head and clam being coordinated to arrive at said tabbing station simultaneously with said picker head moving a tab carried thereby against the underside of the periphery to exten peripherally across the trailing edge of a wound core clamped in said clam.

18. Core feed means as claimed in claim 17 in which said picker head is provided with an upper pick-up face having port means therein and arranged to underlie a tab at said pickup position means for applying suction through said port means with said picker head at said pick-up position to draw a tab against said face and to maintain suction at said face to hold the tab on said face during transfer by said picker head to said tabbing position, and means to release said vacuum to release said tab at said tabbing position.

19. Core feed means as claimed in claim 18 in which means are provided to direct an air jet out through said picker head port means upon release of said vacuum at tabbing position to assist in the applying of a tab to the underside of a wound roll.

20. Core feed means as claimed in claim 18 in which said picker head is resiliently displaceable relative to said turret with said turret stationary, and means are provided to slowly displace said picker head following its arrival at said tab pick-up position and the application of vacuum thererto away from said pick-up position to draw off a tab from the means feeding tabs to said pick-up position while said cradle is in said core pick-up position and said clam is in said aligned position awaiting a wound core.

21. Core feed means as claimed in claim 17 in which the tabs to be fed to said pick-up position are mounted serially on a carrier web having feed perforations therein and said means for feeding tabs to said pick-up position comprises a pin wheel adapted to engage the tab carrying web led over the top thereof and presenting a plurality of pin projections for engagement in the web perforations for positive web advance on pin wheel rotation to advance a tab to a position at the underside of the wheel constituting said tab pick-up position, a ratchet associated with said pin wheel, and a pawl engaging said ratchet and operated in consequence of movement of said picker head to effect through web feed the advance of a tab to said pick-up position for each picker head movement cycle following picking up of the preceeding tab from said tab pick up position to tabbing position and return.

22. Core feed means as claimed in claim 21 in which the direction of the tab carrying web feed is transverse the direction of motion of said picker head.

* * * * *